US009227394B2

(12) United States Patent
Sumiyoshi

(10) Patent No.: US 9,227,394 B2
(45) Date of Patent: Jan. 5, 2016

(54) HEAD ADJUSTMENT METHOD, HEAD-DRIVING DEVICE AND IMAGE-FORMING DEVICE

(71) Applicant: FUJIFILM Corporation, Tokyo (JP)

(72) Inventor: Yuta Sumiyoshi, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/793,128

(22) Filed: Jul. 7, 2015

(65) Prior Publication Data

US 2015/0306870 A1 Oct. 29, 2015

Related U.S. Application Data

(63) Continuation of application No. PCT/JP2013/084830, filed on Dec. 26, 2013.

(30) Foreign Application Priority Data

Jan. 21, 2013 (JP) ..... 2013-008420

(51) Int. Cl.
*B41J 2/045* (2006.01)

(52) U.S. Cl.
CPC ..... *B41J 2/04505* (2013.01); *B41J 2/04581* (2013.01)

(58) Field of Classification Search
CPC .. B41J 2/04505; B41J 2202/20; B41J 2/2146; B41J 2/2135; B41J 2/04581; B41J 2/04508; B41J 2202/21; B41J 2/04573; B41J 19/145
See application file for complete search history.

(56) References Cited

U.S. PATENT DOCUMENTS 7,819,494 B2 * 10/2010 Sheahan ..... B41J 2/0451 347/12
7,871,145 B1 * 1/2011 Enge ..... B41J 2/2135 347/14
2005/0062784 A1 3/2005 Matsuzaki et al.
(Continued)

FOREIGN PATENT DOCUMENTS

JP 2005-053167 A 3/2005
JP 2006-116845 A 5/2006
(Continued)

OTHER PUBLICATIONS

International Search Report; PCT/JP2013/084830; Apr. 1, 2014.
(Continued)

*Primary Examiner* — Thinh Nguyen
(74) *Attorney, Agent, or Firm* — Studebaker & Brackett PC

(57) ABSTRACT

According to an aspect of the present invention, in a case where a part of the plurality of head modules to each of which an initial amount of correction is set is replaced, a mounting position of the replaced head module in the first direction varies in a range within the mounting tolerance. However, the initial amount of correction in the first direction of each of the head modules is set by adding the amount of the offset more than the mounting tolerance, a mounting position of the replaced head module is always upstream from the offset reference line in the feeding direction of a recording medium. Thus, it is required to correct only an amount of correction of the replaced head module with reference to the offset reference line, so that the amount of correction of a non-replaced head module can be used without being corrected.

18 Claims, 15 Drawing Sheets

(56) References Cited

U.S. PATENT DOCUMENTS

| | | | | |
|---|---|---|---|---|
| 2009/0058906 | A1 | 3/2009 | Tatsuta | |
| 2012/0033006 | A1 * | 2/2012 | Murayama | B41J 2/2135 347/14 |

FOREIGN PATENT DOCUMENTS

| | | | |
|---|---|---|---|
| JP | 2006-305763 | A | 11/2006 |
| JP | 2007-021834 | A | 2/2007 |
| JP | 2010-064466 | A | 3/2010 |
| JP | 2010-115783 | A | 5/2010 |

OTHER PUBLICATIONS

Written Opinion of the International Searching Authority; PCT/JP2013/084830; Apr. 1, 2014.

Notification of Transmittal of Translation of the International Preliminary Report on Patentability and Translation of Written Opinion of the International Searching Authority: PCT/JP2013/084830 issued on Jul. 30, 2015.

* cited by examiner

FIG.4

| MODULE NUMBER | AMOUNT OF CORRECTION IN Y-DIRECTION |
|---|---|
| 1 | $C_1$ |
| 2 | $C_2$ |
| 3 | $C_3$ |
| 4 | $C_4$ |
| 5 | $C_5$ |
| ⋮ | ⋮ |

HEAD ADJUSTMENT METHOD, HEAD-DRIVING DEVICE AND IMAGE-FORMING DEVICE

CROSS-REFERENCE TO RELATED APPLICATIONS

This application is a Continuation of PCT International Application No. PCT/JP2013/084830 filed on Dec. 26, 2013, which claims priority under 35 U.S.C. §119(a) to Japanese Patent Application No. 2013-008420 filed on Jan. 21, 2013. Each of the above application(s) is hereby expressly incorporated by reference, in its entirety, into the present application.

BACKGROUND OF THE INVENTION

1. Field of the Invention

The present invention relates to a head adjustment method of adjusting a recording position of a line head (line bar) composed of a plurality of head modules, and a head-driving device and an image-forming device to which the method is applied.

2. Description of the Related Art

In a line head that is formed in an elongated strip shape by joining a plurality of head modules with each other, there is known a correction method of adjusting ejecting timing for each of head modules to correct displacement of a recording position caused by a variation (misregistration) of a mounting position of a head module in a direction parallel to a feeding direction of a paper sheet (referred to as a sub-scanning direction, or a Y-direction) (refer to PTLs 1 to 3).

In PTLs 1 (Japanese Patent Application Laid-Open No. 2006-116845) and 2 (Japanese Patent Application Laid-Open No. 2005-053167), with reference to a specific head module among a plurality of head modules, increase and decrease in ejecting timing of modules other than the specific module is controlled by adjusting a recording position in the Y-direction.

In PTL 3 (Japanese Patent Application Laid-Open No. 2006-305763), correction in the Y-direction is adjusted by controlling timing of each of the head modules with reference to a median line in the Y-direction in a print pattern. That is, according to the paragraph [0045] of PTL 3, an unit pattern recorded by each of the head modules is adjusted so that the center thereof is aligned with a main scanning direction (such as the center of a head unit) (refer to FIG. 9 of PTL 3).

SUMMARY OF THE INVENTION

In an aspect in which a print head (line head) in an elongated strip shape is composed of a plurality of head modules, if a part of the head modules fails, replacement for each of head modules constituting each of line head bars is desired instead of replacement for each of the line head bars to reduce running costs, and the like.

Even in a case where a part of head modules arranged in a line head is replaced, adjustment of a recording position in the Y-direction is required for the line head after replacement. For example, in aspects described in PTLs 1 and 2, if a single head module is set for a replacing object, there is a possibility that a replaced head module may be a "reference module" to be the reference in control of ejecting timing for correction in the Y-direction. In this way, if a replaced module is the "reference module", it is required to readjust ejecting timing of all head modules in a line head to cause adjusting processing and operation to be complicated.

On the other hand, in an aspect described in PTL 3, although timing of each of the head modules (short heads) is controlled with reference to "a median line" (unit's center) in the Y-direction in a print pattern, the unit's center has no clear reference point (reference line) that is to be found out from a print pattern. Thus, adjusting processing is very complicated, and particularly there is a risk that it is difficult to achieve quality in a high resolution print (such as 1200 dpi or more). In addition, in the invention described in PTL3, there is required processing of not only delaying ejecting timing, but also advancing it. Accordingly, a control unit is required to have many image data buffers (a memory area for temporarily storing image data).

The present invention is made in light of the above-mentioned circumstances, and it is an object of the present invention to provide a head adjustment method capable of solving the problem described above to enable adjustment of a recording position in the Y-direction at the time of replacing a module to be facilitated. In addition, it is an object of the present invention to provide a head adjustment method, a head-driving device, and an image-forming device using the head-driving device, which are capable of easily performing correction processing of a recording position with high accuracy, and of configuring a circuit in a small scale.

In order to solve the problem described above, the following invention aspects are provided.

(First Aspect): A head adjustment method in accordance with a first aspect is for adjusting a recording position of each of a plurality of head modules of a line head formed by a combination of the plurality of head modules, and the head adjustment method includes the steps of: measuring an amount of misregistration for each of the head modules, corresponding to an amount of relative misregistration of each of the head modules in a direction parallel to a feeding direction of a recording medium, with reference to a position of a slowest module among the plurality of head modules, the slowest module being arranged on a most downstream side in the feeding direction of the recording medium with respect to a line head; determining an amount of correction of each of the head modules by determining a value corresponding to an amount in which an amount of an offset more than a mounting tolerance of the head modules in the direction parallel to the feeding direction is added to the amount of misregistration measured for each of the head modules; storing the amount of correction in a storage unit; and controlling recording timing of each of the head modules on a basis of the amount of correction stored in the storage unit.

For convenience of explanation, the direction parallel to the feeding direction in which the recording medium is fed with respect to the line head is referred to as a "first direction", and a width direction of recording medium, orthogonal to the first direction, is referred to as a "second direction". The first direction is equivalent to the "Y-direction" or the "sub-scanning direction", the second direction is equivalent to an "X-direction" or the "main scanning direction".

According to the first aspect, the amount of correction for adjusting a recording position in the first direction is set for each of all of the head modules constituting the line head. The amount of correction is set as a value corresponding to an amount acquired by adding the amount of the offset more than the mounting tolerance of the head modules in the first direction to the amount of relative misregistration in the first direction with reference to the position of the slowest module (referred to as "the amount of misregistration in the first direction").

The amount of correction for each of the head modules determined as above is all the same sign, as well as equal to or more than the amount of the offset more than the mounting tolerance. Recording timing each of the head modules is adjusted on a basis of the amount of correction, so that a position offset further downstream in the feeding direction of a recording medium from the position of the slowest module by the amount of the offset is set as a reference line (position) for controlling recording timing of each of the head modules. The reference line (position) is referred to as an offset reference line (position).

As described above, in a case where a part of the plurality of head modules to each of which an initial amount of correction is set is replaced, a mounting position of the replaced head module in the first direction varies in a range within the mounting tolerance. However, the initial amount of correction in the first direction of each of the head modules is set by adding the amount of the offset more than the mounting tolerance, a mounting position of the replaced head module is always upstream from the offset reference line in the feeding direction of a recording medium. Thus, it is required to correct only an amount of correction of the replaced head module with reference to the offset reference line, so that the amount of correction of a non-replaced head module can be used without being corrected.

(Second Aspect): The head adjustment method in accordance with the first aspect may be configured to include, in a case where a part of the plurality of head modules is replaced, the steps of: acquiring the amount of relative misregistration of the replaced head module in the direction parallel to the feeding direction in a mounting state after replacement; determining an amount of correction for the replaced head module on a basis of the acquired amount instead of an amount of correction set to the head module before the replacement; and storing the amount of correction after the replacement in the storage unit, and in the method, recording timing of the replaced head module is controlled on a basis of the amount of correction after the replacement, and recording timing of a non-replaced head module is controlled on a basis of the amount of correction before the replacement.

(Third Aspect): The head adjustment method according to the first or second aspect may be configured so that the step of controlling timing includes delay processing of delaying recording timing in accordance with the amount of correction.

Since the amount of correction set to each of all of the head modules is the same sign, a recording position can be adjusted by only the delay processing.

(Fourth Aspect): The head adjustment method according to any one of the first to third aspects may be configured to include the steps of: possessing image data for at least a pixel row corresponding to the amount of the offset in an image data memory unit; outputting nozzle control data for controlling an ejecting operation of each of nozzles in each of the head modules in response to a timing signal generated in accordance with the amount of correction; and driving an ejecting energy generation element corresponding to each of the nozzles in the respective head modules by outputting a driving voltage signal to the ejecting energy generation element.

There are an aspect of using a piezoelectric element as the "ejecting energy generation element" (piezojet method), an aspect of using an electrostatic actuator as the "ejecting energy generation element", an aspect of using a heat generation element (heater) in a thermaljet method, as the "ejecting energy generation element", and the like.

(Fifth Aspect): The head adjustment method according to any one of first to fourth aspects may be configured so that the amount of correction is indicated by a numeric value in terms of pixels defined by a recording resolution realized by relative movement between the line head and the recording medium.

As a unit indicating each of amounts, such as an amount of misregistration, an amount of offset, an amount of correction, of each of the head modules in the first direction, which are acquired with reference to a position of the slowest module, there are available appropriate units, such as a distance (length) unit, a pixel (pixel) unit defined by a recording resolution, and a time unit in consideration of a relative movement speed of the recording medium with respect to the line head, and the units are convertible into each other.

The mounting tolerance of the head module in the first direction can be set at an appropriate value depending on design, so that the amount of the offset more than the mounting tolerance also can be set at an appropriate value.

Although an upper limit of the amount of the offset is not particularly limited, as the amount of the offset is increased, the image data memory unit (buffer) that temporarily stores image data requires more capacity. Thus, it is preferable that the amount of the offset is 10 pixels or less in terms of pixels in view of reduction in capacity. It is more preferable that the amount of the offset is 8 pixels or less in terms of pixels, and it is most preferable that the amount of the offset is 6 pixels or less.

(Sixth Aspect): A head-driving device in accordance with a sixth aspect controls a recording operation of each of a plurality of head modules of a line head formed by a combination of the plurality of head modules, and includes: a storage unit that stores an amount of correction of each of the head modules that is a value corresponding to an amount acquired by adding an amount of an offset more than a mounting tolerance of the head modules in a direction parallel to the feeding direction to the amount of misregistration for each of the head modules corresponding to an amount of relative misregistration each of the head modules in the direction parallel to the feeding direction that is acquired with reference to a position of a slowest module among the plurality of head modules, the slowest module being arranged on a most downstream side in the feeding direction of the recording medium with respect to the line head; and a timing control unit that controls recording timing of the head modules on a basis of the amount of correction stored in the storage unit.

According to the sixth aspect, it is possible to facilitate adjustment of a recording position in the first direction (Y-direction) at the time of module replacement, as well as possible to provide a head-driving device capable of easily processing correction of recording position with high accuracy. In addition, it is possible to realize the head-driving device with a relatively small circuit size.

(Seventh Aspect): The head-driving device according to the sixth aspect may be configured so that in a case where a part of the plurality of head modules is replaced, an amount of correction after replacement is set for the replaced head module instead of the amount of correction set to the head module before replacement, and the amount of correction after the replacement is stored in the storage unit, and configured so that recording timing of the replaced head module is controlled on a basis of the amount of correction after the replacement, and recording timing of a non-replaced head module is controlled on a basis of an amount of correction same as the amount of correction before the replacement.

(Eighth Aspect): The head-driving device according to the sixth or seventh aspect may be configured so that the timing control unit includes a delay processing section that delays a trigger signal for ejection in units of pixels to be inputted to the timing control unit in accordance with the amount of correction.

(Ninth Aspect): The head-driving device according to any one of the sixth to eighth aspects includes: an image data memory unit that is capable of possessing image data for a pixel row corresponding to at least the amount of offset; a nozzle control data output unit that outputs nozzle control data for controlling an ejecting operation of each of nozzles in the respective head modules in response to the timing signal from the timing control unit; and a driving unit that outputs a driving voltage signal to an ejecting energy generation element corresponding to each of the nozzles in the respective head modules to drive the ejecting energy generation element.

(Tenth Aspect): An image-forming device in accordance with a tenth aspect includes: a line head that is formed in combination with a plurality of head modules; a feeding unit that feeds the recording medium with respect to the line head; and the head-driving device according to any one of the seventh to tenth aspects.

According to the present invention, it is possible to easily correct displacement of a recording position caused by a mounting position of a head module with high accuracy. In addition, according to the present invention, it is possible to facilitate correction processing at the time of replacing a head module. Further, it is possible to realize the head-driving device with a relatively small circuit size.

BRIEF DESCRIPTION OF THE DRAWINGS

FIG. 4 is a conceptual diagram of data on the amount of correction in the Y-direction set for each of the head modules.

DETAILED DESCRIPTION OF THE EMBODIMENTS

Hereinafter, embodiments of the present invention will be described in detail with reference to the accompanying drawings.

Description of Technical Problem by Specific Examples

Figure 1:
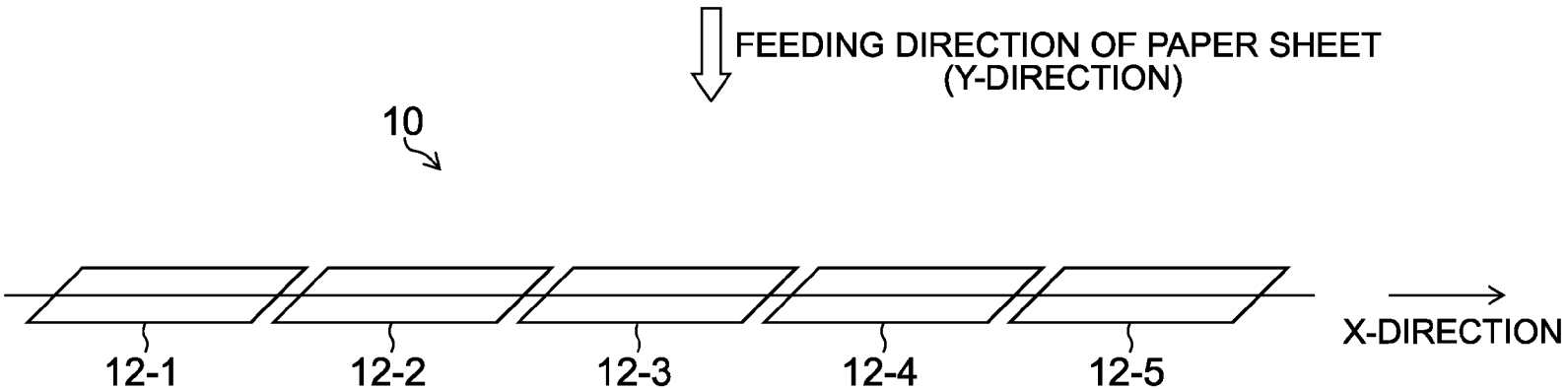
FIG. 1 is a schematic plan view of a line head formed in combination with a plurality of head modules.

Prior to description of the embodiments of the present invention, first a technical problem to be solved by the invention will be described on the basis of a specific example. FIG. 1 is a schematic plan view of a line head formed in combination with a plurality of head modules. FIG. 1 shows an ideal line head bar in which each of the head modules are assembled according to design without an assembly error. As shown in FIG. 1, a line head 10 is formed in combination with a plurality of head modules 12-*i* (i=1, 2, . . . ).

In FIG. 1, a direction shown by an open arrow (a downward direction) is a feeding direction of a paper sheet. In the present specification, the feeding direction of a paper sheet is referred to as a "Y-direction", and a width direction of a paper sheet orthogonal to the feeding direction of a paper sheet (a traverse direction in FIG. 1) is referred to as an "The X-direction". One line head 10 (a line bar in an elongated strip shape) is formed by an arrangement configuration in which a plurality of head modules 12-*i* (i=1, 2, . . . ) is arranged along the X-direction orthogonal to the feeding direction of a paper sheet (Y-direction).

Although FIG. 1 shows a configuration in which five head modules 12-*i* (i=1, 2, . . . 5) are arranged, the number of the head modules for forming the one line head 10 is not particularly limited. It is possible to form a print head bar with a desired recording width in the X-direction in combination with an appropriate number of two or more of the head modules. For convenience of indication, in a case where a content common to each of the head modules 12-*i* (i=1, 2, . . . 5) is described, the head modules may be designated by reference numeral 12.

Each of the head modules 12 is an ink jet head module capable of recording dots on a recording medium (paper sheet) by ejecting ink droplets by an ink jet method. Although a detailed structure of each of the head modules 12 is not shown, a plurality of ink ejecting ports (nozzles) are arranged in an ink ejecting face of each of the head modules 12 to form a two-dimensional array, and in the X-direction, the array makes nozzle density that achieves a predetermined recording resolution (such as 1200 dpi).

Even in a joint of the head modules 12 adjacent to each other in the X-direction in the line head 10, the recording resolution same as that of the head module is achieved. As a result, a target recording resolution (such as 1200 dpi) is achieved by an entire bar of the line head 10.

Figure 2:
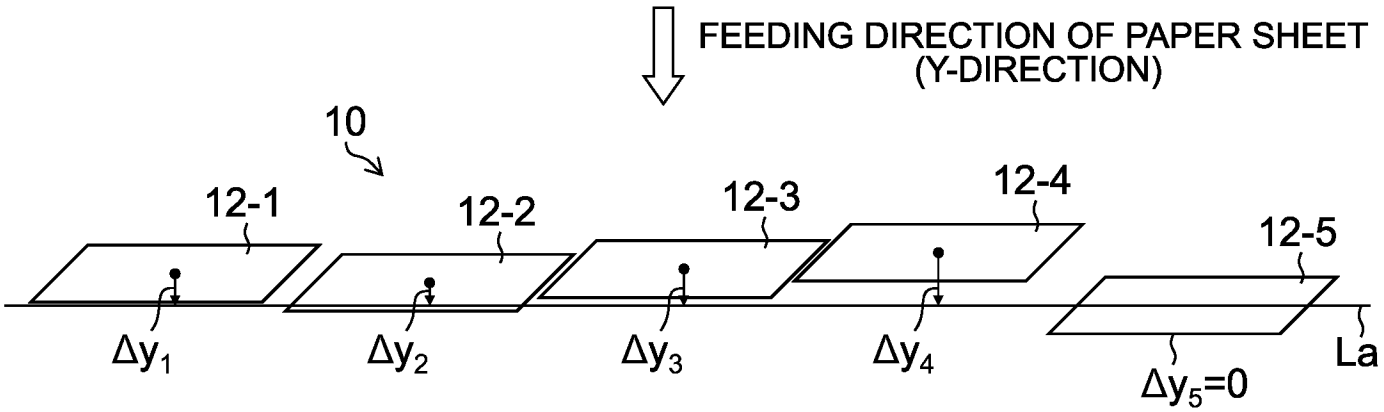
FIG. 2 is a conceptual diagram showing an example of a correction technique (correction in the Y-direction) in a case where a mounting position of each of the head modules in the Y-direction is displaced from an ideal position.

FIG. 2 is a conceptual diagram showing an example of a correction technique (referred to as "correction in the Y-direction") in a case where a mounting position of each of the head modules in the Y-direction is displaced from an ideal position. In a case where the line head 10 in an elongated strip shape is formed by arranging the plurality of head modules 12 in the X-direction, a variation in a head module position may occur in the Y-direction depending on assembly accuracy of the head modules 12. In fact, although displacement of the mounting position may occur also in the X-direction, another correction technique such as correction of uneven concentration is available for compensation (correction) for print quality with respect to a variation in a module mounting position in the X-direction. Thus, hereinafter description will be focused on only displacement of a mounting position in the Y-direction.

As shown in FIG. 2, in a case where there is a variation in a mounting position of each of the head module 12 in the Y-direction, the following method is conceived as a measure for the case. That is, it is conceived that, with reference to a head module whose mounting position is closest to a paper ejection side in a feeding direction of a paper sheet among the plurality of head modules 12 constituting the line head 10 (a head module positioned most downstream in the feeding direction of a paper sheet), ejecting timing of other head modules is delayed to correct the variation.

In the example of FIG. 2, a rightmost head module 12-5 among five head modules **12-*i* (i=1, 2, . . . 5) arranged in the X-direction is mounted at a position closest to the paper ejection side. The head module positioned closest to the paper ejection side in the feeding direction of a paper sheet as above is referred to as a "slowest module", and is designated by reference numeral 12-5 in the example of FIG. 2. A position of the slowest module 12-5 in the Y-direction (a line position of a straight line designated by reference character La in FIG. 2) is set as a reference position. A position designated by the La is referred to as a "slowest module reference position". The slowest module reference position La may be set at a specific reference position in the slowest module 12-5** (such as a center position in a nozzle area in the Y-direction).

Ejecting timing of the head modules **12-*i* (i=1 to 4) other than the slowest module 12-5** can be adjusted in accordance with an amount of relative displacement from the slowest module reference position La.

In FIG. 2, the reference line (the slowest module reference position La) indicating the position of the slowest module 12-5 in the Y-direction is set so that a difference Δyi (i=1 to 5) in position in the Y-direction between a mounting position of each of the head modules **12-*i*** (i=1 to 5) in the Y-direction and the slowest module reference position La can be acquired.

The difference Δyi (i=1 to 5) in position in the Y-direction is indicated by a distance between a specific position in the Y-direction of each of the head modules 12 (such as the center position in the nozzle area in the Y-direction) and the slowest module reference position La. Then, a delay time (tdi=Δyi/v) of ejecting timing of each of the head modules is set from the difference Δyi in position in the Y-direction and a paper sheet feeding speed v.

A parameter indicating an amount of delay of ejecting timing is not limited to a numeric value in units of time (a numeric value indicating a delay time) as indicated by the tdi above, and there are available a numeric value indicating a "distance (length)" corresponding to a relative difference Δyi in position in the Y-direction, and a value converted from the distance (length), in terms of the number of pixels corresponding to a recording resolution. It is arbitrary to use an index in any one of the time unit, the distance (length) unit, and the pixel unit, and the units are convertible into each other.

As above, it is conceived to use a configuration in which ejecting timing is delayed for each of the modules in accordance with a position of each of the head modules with reference to a position of the slowest module.

Unfortunately, if the method as described above is used, a problem as described below occurs. That is, in a case where a head module is replaced in units of a head module due to a failure of the head module constituting the line head 10, and if assembly accuracy of a replaced module is poor and the replaced module serves as the "slowest module", all head modules other than the replaced head module are required to change a correction parameter in the Y-direction (a correction value for adjusting ejecting timing). As a result, processing becomes complicated.

(Overview of Correction in Y-Direction in Accordance with Embodiments of the Present Invention)

Figure 3:
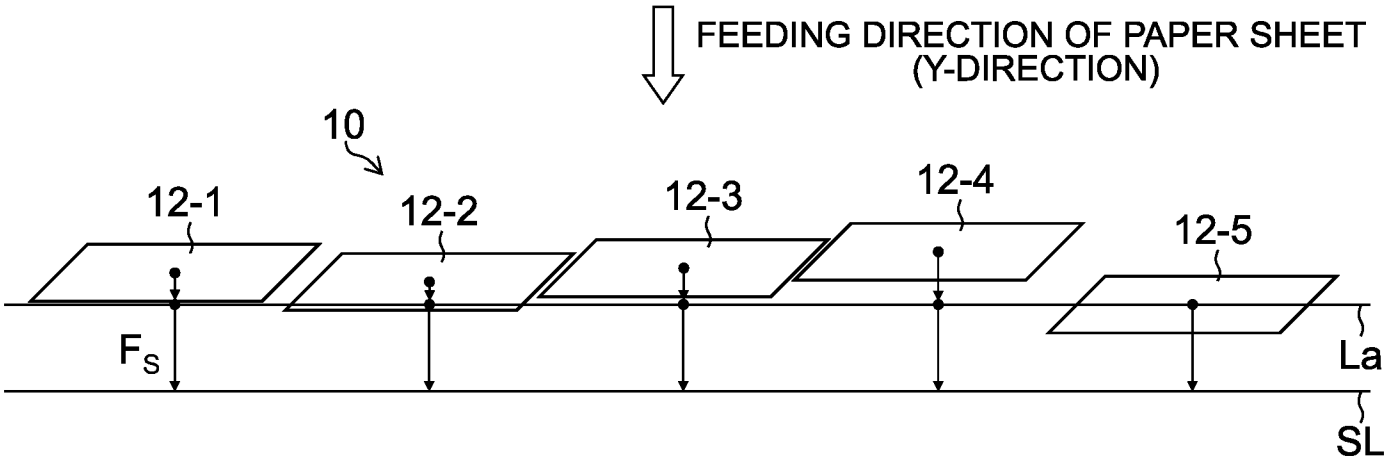
FIG. 3 is a conceptual diagram of correction in the Y-direction by a print head adjustment method in accordance with an embodiment of the present invention.

FIG. 3 is a conceptual diagram of correction in the Y-direction by a print head adjustment method in accordance with an embodiment of the present invention. With respect to the problem described above, the embodiments of the present invention use the following correction method. That is, the amount of correction corresponding to the amount of relative misregistration (the difference Δyi in position in the Y-direction) of each of the head modules in the Y-direction acquired with reference to a position of the slowest module, described in FIG. 2, is used, as well as the amount of an offset Fs more than a mounting tolerance of the head modules 12 in the Y-direction is added to the correction parameter in the Y-direction of all of the head modules **12-*i* (i=1, 2 . . . 5) in advance, as shown in FIG. 3**.

With reference to a relationship with FIG. 2, a fixed amount of an offset Fs more than a mounting tolerance TL of the head modules in the Y-direction is added to the value Δyi (i=1, 2 . . . ) corresponding to an amount of relative misregistration of each of the head modules determined with reference to the slowest module 12-5 so that the added value is set as an amount of correction Ci (i=1, 2 . . . ) in the Y-direction of each of the head modules.

The amount of correction Ci in the Y-direction is used for adjustment for delaying ejecting timing (corresponding to "recording timing") of each of the head modules with reference to a position of the reference line (offset reference line) designated by reference character SL in FIG. 3.

The amount of correction in the Y-direction Ci may be indicated by a value in units of distance (length). Alternatively, the amount of correction in the Y-direction Ci may be indicated by a value in a pixel unit defined by a recording resolution, converted from the value indicated in units of distance (length). The present embodiments use a value in terms of pixels. For example, in a case where the recording resolution is 1200 dpi, a width of one pixel is about 20.4 μm. Thus, it is possible to convert a unit of length to a unit of pixel by using this kind of a relationship.

A relative amount Δyi of misregistration in the Y-direction of each of the head modules determined with reference to the slowest module is measured in units of micrometer, for example, as well as the mounting tolerance TL of the head modules in the Y-direction is defined in in units of micrometer. The numeric values in units of micrometer are convertible into a numeric value in a unit in terms of pixels.

In the example of FIG. 3, the head module 12-5 with a module number i=5 is a slowest module. With reference to the slowest module (12-5), the value Δyi indicating the amount of relative misregistration of each of the head modules **12-*i*** is set.

For the slowest module, Δy5 is "0". Each of other Δy1, Δy2, Δy3, and Δy4 is set as a positive value. The value Δyi may be in units of length (distance), or may be a value in terms of pixels in units of size of one pixel in a recording resolution. Since a value in terms of pixels can be used easier in control of delaying ejecting timing, a value in terms of pixel is used in the present example.

The amount of an offset Fs is set at a value more than the mounting tolerance TL. For example, in a case where a mounting tolerance of 240 μm (±120 μm) is set, the amount of an offset can be set at a value for 12 pixels ((25400 μm/1200 pix)×12=254 μm). Since a mounting tolerance is a "constant" determined depending on design, the amount of an offset also can be set in advance on the basis of the mounting tolerance. In addition, the amount of an offset can be changed to an appropriate value as long as the value is more than a mounting tolerance. The amount of an offset is set within capacity of a buffer memory capable of holding image data. As the amount of an offset is increased, capacity of a buffer memory is required more. Thus, in view of reduction in memory capacity, it is preferable that the amount of an offset is 10 pixels or less in terms of pixels. It is more preferable that the amount of the offset is 8 pixels or less in terms of pixels, and it is most preferable that the amount of the offset is 6 pixels or less.

A value "Δyi+Fs" acquired by adding the amount of an offset Fs to the amount Δyi of relative misregistration in the Y-direction of each of the head modules 12-*i* is set as an amount of correction in the Y-direction Ci of each of the head modules 12-*i* (Ci=Δyi+Fs).

When the amount of correction in the Y-direction Ci is acquired, each of values Δyi and Fs in terms of pixels may be added as described above, or the values in units of length may be added and then be set in terms of pixels.

For example, in a case where a mounting tolerance of 240 μm (±120 μm) is set, the amount of an offset can be set at a value for 12 pixels (about 254 μm).

As above, the amount of correction in the Y-direction Ci of each of the head modules 12-*i* is set (i=1 to 5) so that ejecting timing of all of the head modules 12 is adjusted with reference to a position (off-set reference position) of the line designated by reference character SL in FIG. 3.

In addition, since a correction offset in the Y-direction more than a mounting tolerance is given, if any head module in the line head 10 is replaced, the replaced module is arranged upstream from the reference line designated by reference character SL in FIG. 3 in the feeding direction of a paper sheet (is not positioned downstream from the line SL). Thus, the line head 10 after replacement of the module is not required to correct the reference line SL of correction in the Y-direction, so that the amount of correction in the Y-direction (correction parameter in the Y-direction) may be corrected for only the replaced head module.

That is, each of head modules other than the replaced module can still use an original value without correcting the amount of correction in the Y-direction.

FIG. 4 is a conceptual diagram of data on the amount of correction in the Y-direction set for each of the head modules 12-*i* (i=1 to 5). As shown in FIG. 4, the amount of correction in the Y-direction Ci is set for each of the head modules. As described before, the amount of correction in the Y-direction Ci is acquired by adding the amount of an offset Fs to the amount Δyi of misregistration in Y-direction with reference to the slowest module, and is always defined as a value of the same sign for all of the head modules (here, as a positive value) (Ci=Δyi+Fs>0).

Correction value data on each of the head modules, such as described in FIG. 4, is held in a nonvolatile memory, magnetism disk, or another storage means, to be used in control of ejecting timing at the time of an ejecting operation.

Measurement of an initial amount Δyi of misregistration in the Y-direction of each of the head modules 12 in the line head 10, and derivation of an optimum amount of correction in the Y-direction for a replaced head module, may be performed as follows: a sensor is attached to each of the head modules 12 to measure a relative position for calculation of the optimum amount of correction; or a test chart is outputted so that a print result thereof is checked. In a case where the test chart is checked for print, a pattern (chart) corresponding to each amount of correction is printed by changing the amount of correction stepwise in one page. As a result, the test chart is not required to be printed multiple times, thereby being efficient.

As the sensor for detecting a position to be mounted in the head module, a magnetic sensor is available, for example.

(Example of Derivation of Amount of Correction in Y-Direction)

Figure 5:
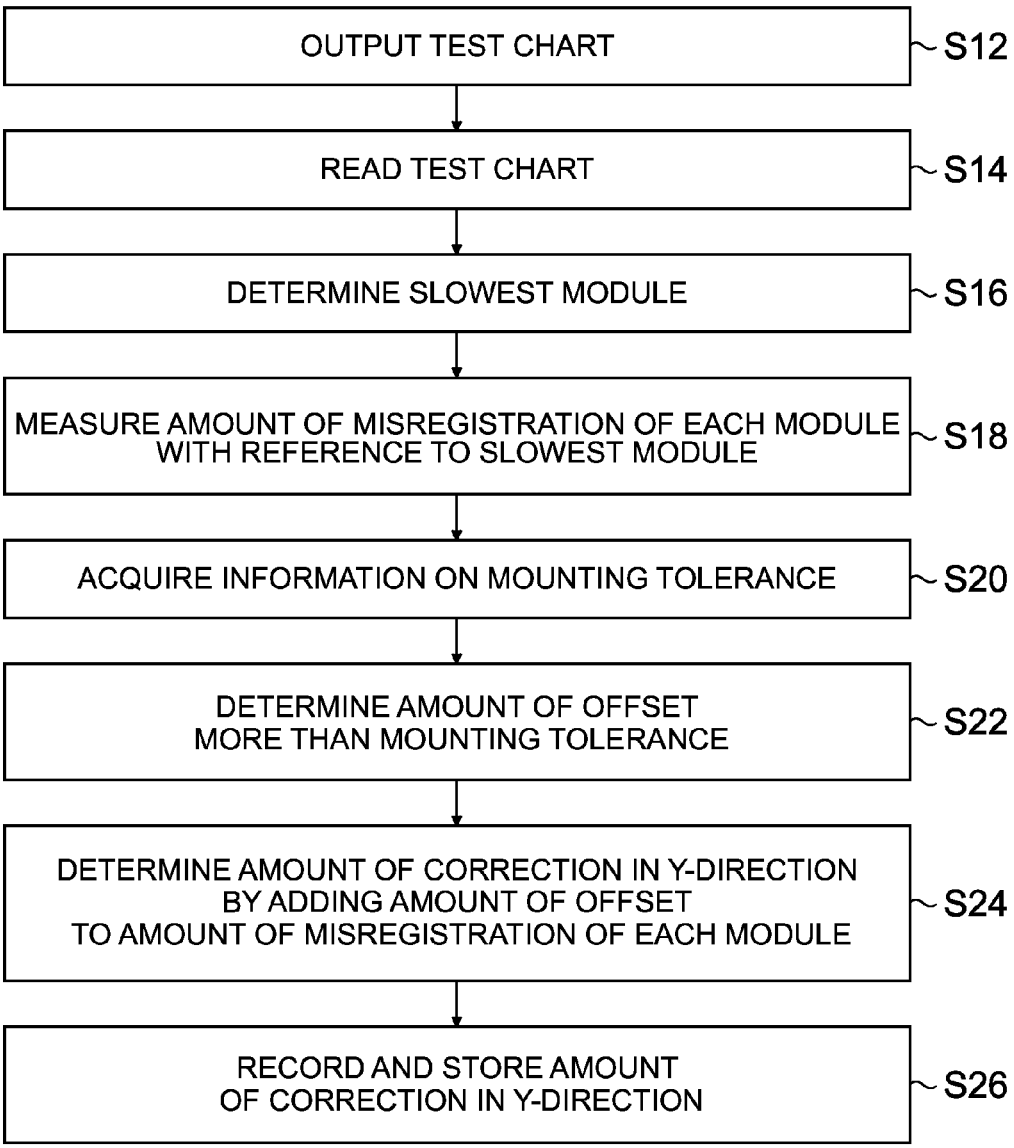
FIG. 5 is a flowchart of a procedure at the time of acquiring the amount of correction in the Y-direction of each of the head modules.

FIG. 5 is a flowchart showing an example of a procedure at the time of acquiring the amount of correction in the Y-direction of each of head modules constituting a line head.

First, a predetermined test chart is printed to be checked for a variation of a position of each of the head modules 12 in the Y-direction (step S12). For example, a pattern of line segments parallel to the X-direction is drawn in each of the head modules 12 so that displacement of a recording position in the Y-direction of the line segments printed for each of the head modules is checked.

It is possible to check a variation of a recording position with respect to an amount of delay of ejecting timing by drawing a plurality of line segments formed by varying the amount of delay of ejecting timing into multiple states on one paper sheet (recording medium).

The test chart outputted in step S12 is read by an image reader such as a scanner (step S14), and then a slowest module is determined (step S16). Then, an amount of relative misregistration of each of the head modules other than the slowest module with reference to a position of the slowest module is measured (step S18).

A series of processes from step S12 to step S18 corresponds to "the step of measuring the amount of misregistration". Instead of a process from step S12 to step S18 of acquiring the amount of relative misregistration of each of the modules, or in combination with the process, it is possible to use a configuration in which position detection means using a magnetic sensor or the like is attached to each of the head modules so that the amount of misregistration of each of the head modules is acquired from information from a position sensor.

Next, information on a mounting tolerance of the head modules is acquired (step S20). The information on a mounting tolerance can be defined from a design value. An amount of an offset in the Y-direction more than the mounting tolerance is determined on the basis of the information (step S22). If the amount of an offset in the Y-direction is determined in advance in consideration of the mounting tolerance, processes from step S20 to S22 can be eliminated. It is also possible to mount a program for automatically determining an appropriate amount of an offset from information on the mounting tolerance determined depending on design.

The order of process of each step shown in FIG. 5 can be appropriately changed. For example, the step of acquiring information on a mounting tolerance may be prior to the step of outputting a test chart.

Next, processing proceeds to step S24, and then the amount of correction in the Y-direction of each of the head modules is determined by adding a fixed amount of an offset to the amount of relative misregistration in the Y-direction of each of the head modules acquired with reference to the slowest module (step S24, corresponding to "the step of determining the amount of correction").

In the present example, the amount of correction in the Y-direction is defined in terms of pixel number in a unit of one pixel in a recording resolution of a printer.

The amount of correction in the Y-direction of each of the head modules acquired as above is stored in a storage unit such as a memory to be stored as a correction parameter in the Y-direction (step S26, corresponding to "the step of storing the amount of correction"). This kind of operation is performed at the time of manufacturing or installing an ink jet recorder, for example, and the correction parameter is stored as an initial amount of correction in the Y-direction in the line head 10.

During printing operation, ejecting timing of each of the head modules is controlled in accordance with the amount of correction in the Y-direction (corresponding to "the step of controlling timing"). That is, processing of delaying ejecting timing for only a pixel number defined by the amount of correction in the Y-direction is performed.

(Correction of Amount of Correction in Y-Direction after Replacement of Head Module)

Figure 6:
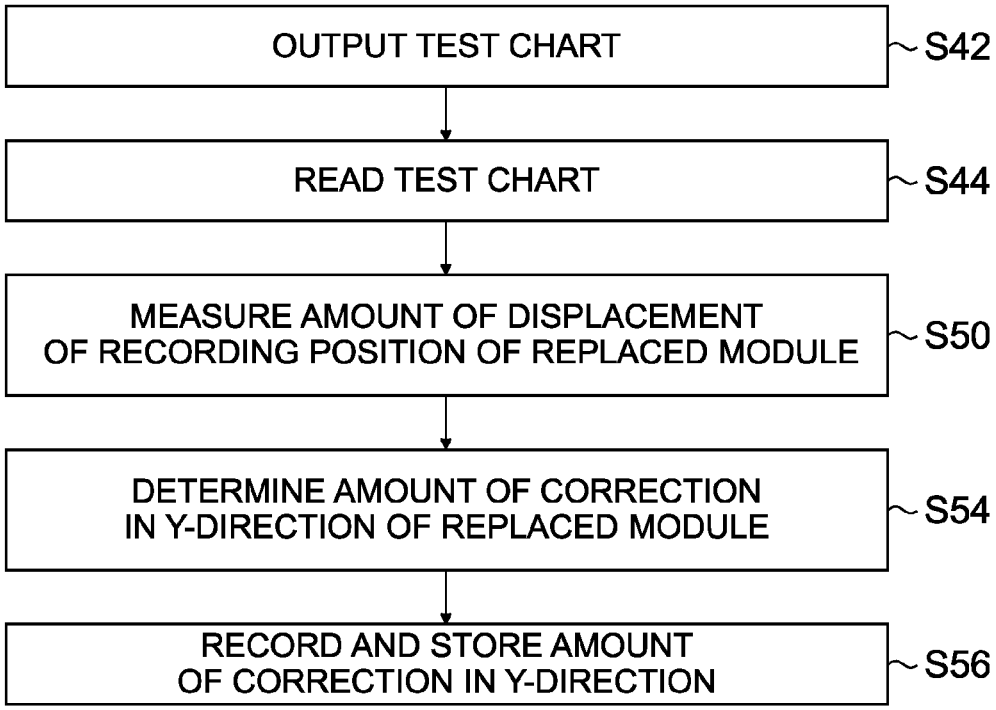
FIG. 6 is a flowchart showing an example of a procedure of correction with the amount of correction in the Y-direction at the time of replacing a part of the head modules.

FIG. 6 is a flowchart showing an example of a procedure of correction with the amount of correction in the Y-direction at the time of replacing a part of a plurality of head modules constituting the line head 10.

In a case where a head module is replaced, the amount of correction in the Y-direction is changed for only the replaced module. That is, a test chart is outputted by the line head 10 after replacement of the module (step S42), and then the test chart outputted is read (step S44). For example, as with step S12 to step S14 of FIG. 5, a pattern of line segments (lines) parallel to the X-direction is drawn to be checked for its print result.

An amount of displacement of a recording position in the Y-direction is measured by comparing lines drawn by the replaced head module and lines drawn by another module comparison (step S50, corresponding to "the step of acquiring the amount of relative displacement of position").

Instead of a method of acquiring the amount of relative misregistration of a head module to be replaced by using measurement of the test chart shown in step S42 to step S50, it is possible to use a configuration in which the amount of relative displacement of a position of a head module in the Y-direction is detected by a sensor provided in a head module or the like.

In this case, a line pattern formed by varying the amount of delay of ejecting timing of the head module to be replaced stepwise is drawn on one paper sheet to enable efficient measurement.

Since a mounting position of the replaced head module is within the mounting tolerance, the replaced head module is not positioned downstream from the offset reference line SL described in FIG. 3 side in the Y-direction. That is, since the amount of correction in the Y-direction of each of the head modules 12 is determined by adding the amount of an offset Fs more than the mounting tolerance in initial head adjustment described in FIG. 5, the mounting position of the replaced head module is always set upstream from the offset reference line SL in the feeding direction of a paper sheet. Thus, it is possible to set a new amount of correction in the Y-direction for the replaced head module as a value of the same sign as that of other non-replaced head modules, with reference to the same offset reference line SL. Then, each of head modules other than the head module to be replaced can use an original amount of correction in the Y-direction as it is.

In step S54 of FIG. 6, for only the replaced head module, the amount of correction in the Y-direction is determined again (corresponding to "the step of determining the amount of correction after replacement"). Accordingly, the amount of correction in the Y-direction of the replaced head module is stored in the storage unit (step S56, "the step of storing the amount of correction after replacement in the storage unit") to update data on the amount of correction in the Y-direction.

As a result, during printing operation after the module is replaced, ejecting timing of each of the head modules is controlled in accordance with the updated data on amount of correction in the Y-direction.

As described in FIGS. 5 and 6, an offset more than the mounting tolerance is required to be added to the correction parameter in the Y-direction only when the initial amount of correction in the Y-direction is set. After that, in a case where a head module has been replaced, the amount of correction in the Y-direction can be corrected for only the replaced module.

(Configuration of Head-Driving Device in Accordance with Present Embodiment)

Figure 7:
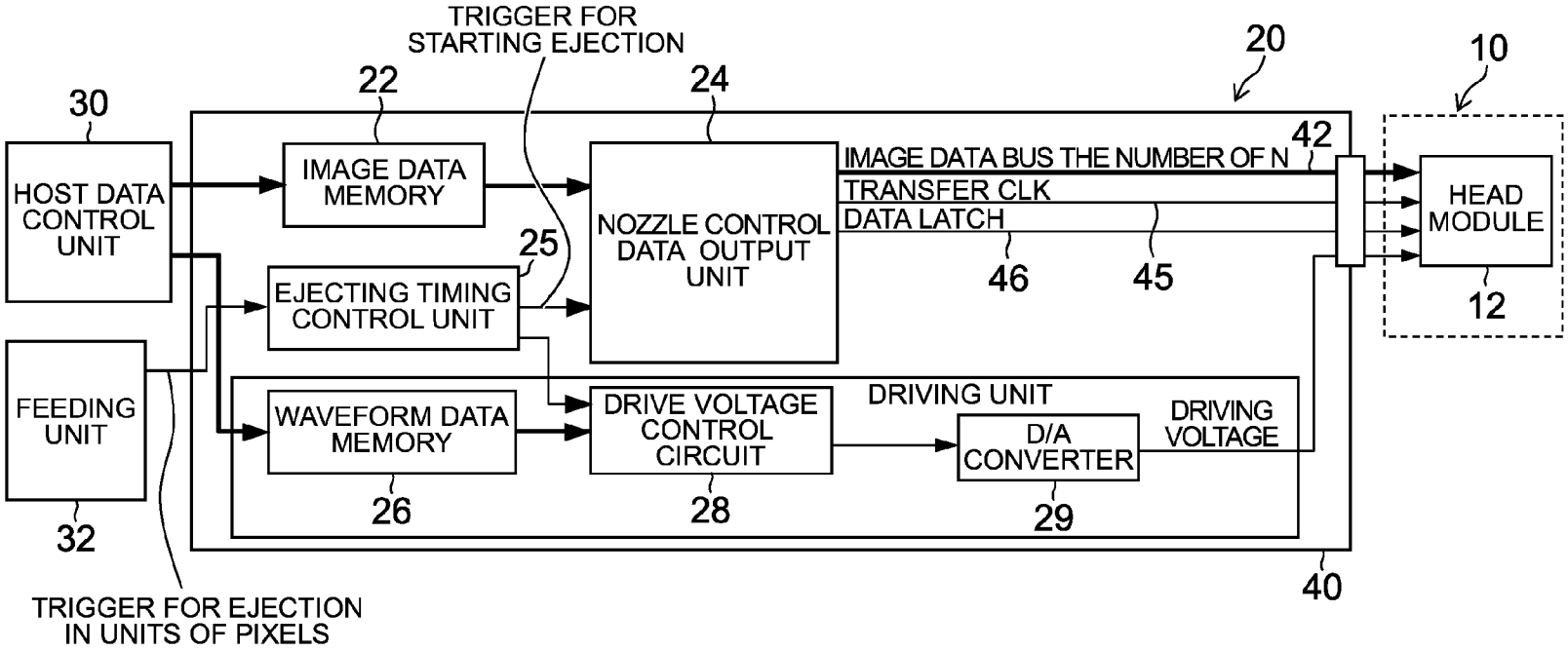
FIG. 7 is a block diagram showing a configuration of the head-driving device in accordance with the embodiment of the present invention.

FIG. 7 is a block diagram showing a configuration of the head-driving device in accordance with the embodiment of the present invention. The line head 10 corresponding to a recording head (print head) includes the plurality of head modules 12. In FIG. 7, although only one head module 12 is shown as a minimum unit to simplify an illustration, in fact, the line head 10 is composed of the plurality of head modules 12 as described in FIGS. 1 to 3.

In an ink ejecting face of the head module 12, a plurality of nozzles (ink ejecting port) is arranged densely to form a two-dimensional array. In addition, the head module 12 is provided with ejecting energy generation elements (piezoelectric elements in the present embodiment) corresponding to the respective nozzles.

The plurality of head modules 12 is joined to each other in a width direction (X-direction) of a paper sheet (not shown) as a recording medium so that it is possible to configure a line head (a page-wide head capable of single pass print) in an elongated strip shape with a nozzle array capable of drawing throughout recordable areas (all areas in a width allowing drawing) in the width direction of the paper sheet at a predetermined recording resolution (such as 1200 dots per inch (dpi)).

A head control unit 20 (corresponding to the "head-driving device") connected to the line head 10 controls drive of the piezoelectric elements corresponding to the respective nozzles of the plurality of head modules 12 to control an operation of ejecting ink from each of the nozzles (ejecting ink or not, and an amount of ejecting droplets).

The head control unit 20 includes an image data memory 22 (corresponding to the "image data memory unit"), a nozzle control data output unit 24, an ejecting timing control unit 25 (corresponding to the "timing control unit"), a waveform data memory 26, a drive voltage control circuit 28, and a D/A converter 29. A combination of the waveform data memory 26, the drive voltage control circuit 28, and the D/A converter 29, shown in FIG. 7, corresponds to the "driving unit". In the present embodiment, the nozzle control data output unit 24 includes a "latch signal transmission circuit", and a data latch signal is outputted to each of the head modules 12 from the nozzle control data output unit 24 at appropriate timing.

The image data memory 22 stores image data expanded to printing image data (dot data). The image data memory 22 has storage capacity capable of holding at least image data for a row of pixels corresponding to the amount of correction in the Y-direction. The waveform data memory 26 stores digital data on drive voltage waveforms for driving the piezoelectric elements. Image data to be inputted into the image data memory 22, and waveform data to be inputted into the waveform data memory 26, are managed by a host data control unit 30 (corresponding to a "host control device"). The host data control unit 30 can be composed of a personal computer or a host computer, for example. The head control unit 20 includes a communication interface (such as a universal serial bus (USB)) as data communication means for receiving data from the host data control unit 30.

In FIG. 1, although only one line head 10 (for one color) is shown for easy explanation, in a case of an ink jet recorder including a plurality of print heads (by color) corresponding to respective colors of a multi-color ink, the head control units 20 are individually (in units of head) provided in the line heads 10 of the respective colors. The head control units 20 of the respective colors are managed by one host data control unit 30. For example, in a configuration including print heads corresponding to respective four colors of cyan (C), magenta (M), yellow (Y), and black (K), there is used a configuration in which the head control unit 20 is provided in each of the print heads for respective CMYK colors, and the head control units 20 for the respective colors are managed by the one host data control unit 30.

When a system is started up, the host data control unit 30 transfers the waveform data and the image data to the head control units 20 for the respective colors. The image data may be transferred in synchronization with feeding of a paper sheet during printing. During the printing, the ejecting timing control unit 25 of each of the colors receives a trigger signal for ejection (trigger for ejection in units of pixels) from a feeding unit 32 for a paper sheet to output a trigger for starting ejection to the nozzle control data output unit 24 and the drive voltage control circuit 28 to start an ejecting operation. When receiving the trigger for starting ejection, each of the nozzle control data output unit 24 and the drive voltage control circuit 28 transfers the waveform data and the image data to the head modules 12 in units of resolution. Accordingly, a selective ejecting operation (on-demand ejection drive control) in accordance with the image data is performed to achieve printing of one page.

Delay control of ejecting timing in which the amount of correction in the Y-direction in the present embodiment is reflected is performed by an ejecting timing control unit 25. The host data control unit 30 holds data on the amount of correction in the Y-direction of each of the head modules 12, and when the system is started up, the host data control unit 30 transmits information on the data to the ejecting timing control unit 25. The ejecting timing control unit 25 holds the data on the amount of correction in the Y-direction, and applies delay processing in accordance with the amount of correction in the Y-direction to the trigger signal for ejection in terms of pixels acquired from the feeding unit 32 to output the trigger for starting ejection.

The drive voltage control circuit 28 outputs drive voltage waveform data to the D/A converter 29 in response to a print timing signal (trigger signal for starting ejection). Accordingly, the drive voltage waveform data is converted into an analog voltage waveform by the D/A converter 29. The analog voltage waveform outputted from the D/A converter 29 is amplified to a predetermined current and voltage suitable for driving the piezoelectric elements by an amplifier circuit (electric power amplifier circuit) that is not shown, and then is supplied to the head modules 12.

In the present embodiment, although the drive voltage waveform data to be supplied to the head module 12 is common, different drive voltage waveform data may be used for each of the head modules 12. In this case, if drive voltage waveform data corresponding to an individual difference of each of the head modules 12 is used, it is possible to perform drawing in higher quality.

The nozzle control data output unit 24 may be composed of a central processing unit (CPU), or a field programmable gate array (FPGA), for example.

In the present embodiment, the FPGA achieves a function of each of the image data memory 22, the nozzle control data output unit 24, the ejecting timing control unit 25, the waveform data memory 26, and the drive voltage control circuit 28, in FIG. 7.

The nozzle control data output unit 24 performs control of transferring nozzle control data on each of the head modules (here, image data corresponding to dot arrangement of a recording resolution) to each of the head modules on the basis of data stored in the image data memory 22. The nozzle control data is image data (dot data) that is used for determining whether the nozzle is turned on (drive for ejection) or turned off (non-drive). The nozzle control data output unit 24 controls opening/closing (ON/OFF) for each of the nozzles by transferring the nozzle control data to each of the head modules.

An image data transmission line (reference numeral 42) allows the nozzle control data outputted from the nozzle control data output unit 24 to be transmitted to each of the head modules therethrough. The image data transmission line (reference numeral 42) is called an "image data bus", a "data bus", or an "image bus", and is composed of a plurality of signal lines (the number of n) ($n \geq 2$). In the present embodiment, hereinafter the image data transmission line is referred to as the "data bus" (reference numeral 42).

The data bus 42 allows image data to be transmitted to the line head 10 from the nozzle control data output unit 24 therethrough. That is, the data bus 42 can be shared as an image data transmission line to each of a plurality of head modules. For example, one end of the data bus 42 is connected to an output terminal (IC pin) of the nozzle control data output unit 24, and the other end thereof is allowed to branch in front of each of the head modules 12. Then, the plurality of head modules 12 is connected to each of branches of the common data bus 42 in parallel.

The data bus 42 may be composed of: a wiring pattern of an electric circuit board 40 on which the nozzle control data output unit 24, the drive voltage control circuit 28, and the like, are mounted; a wire harness; or a combination thereof. In this way, the data bus 42 is connected to each of the head modules 12 from the IC pin of the nozzle control data output unit 24 as a signal source.

A signal line 45 for a transfer clock is individually provided to correspond to each of the head modules 12. In addition a signal line 46 for a data latch signal is individually provided to correspond to each of the head modules 12. The data latch signal is transmitted to each of the head modules 12 from the nozzle control data output unit 24 at a required timing to set a data signal transferred through the data bus 42 as nozzle data of each of the head modules 12. At the time when a fixed amount of image data is transmitted to the head modules 12 from the nozzle control data output unit 24 through the data bus 42, a signal (latch signal) called a data latch is transmitted to the head modules 12. At the timing of transmission of the data latch signal, ON/OFF data on displacement of the piezoelectric element in each of the modules is determined. After that, a drive voltage is applied to the head modules 12 to allow the piezoelectric element set to be turned on to be displaced so that ink droplets are ejected. The ink droplets ejected as above adhere (deposited) to a paper sheet to perform printing at a desired recording resolution. On the other hand, the piezoelectric element set to be turned off is not displaced even if a drive voltage is applied thereto, so that no droplet is ejected.

(Example of Detailed Configuration of Ejecting Timing Control Unit 25)

Figure 8:
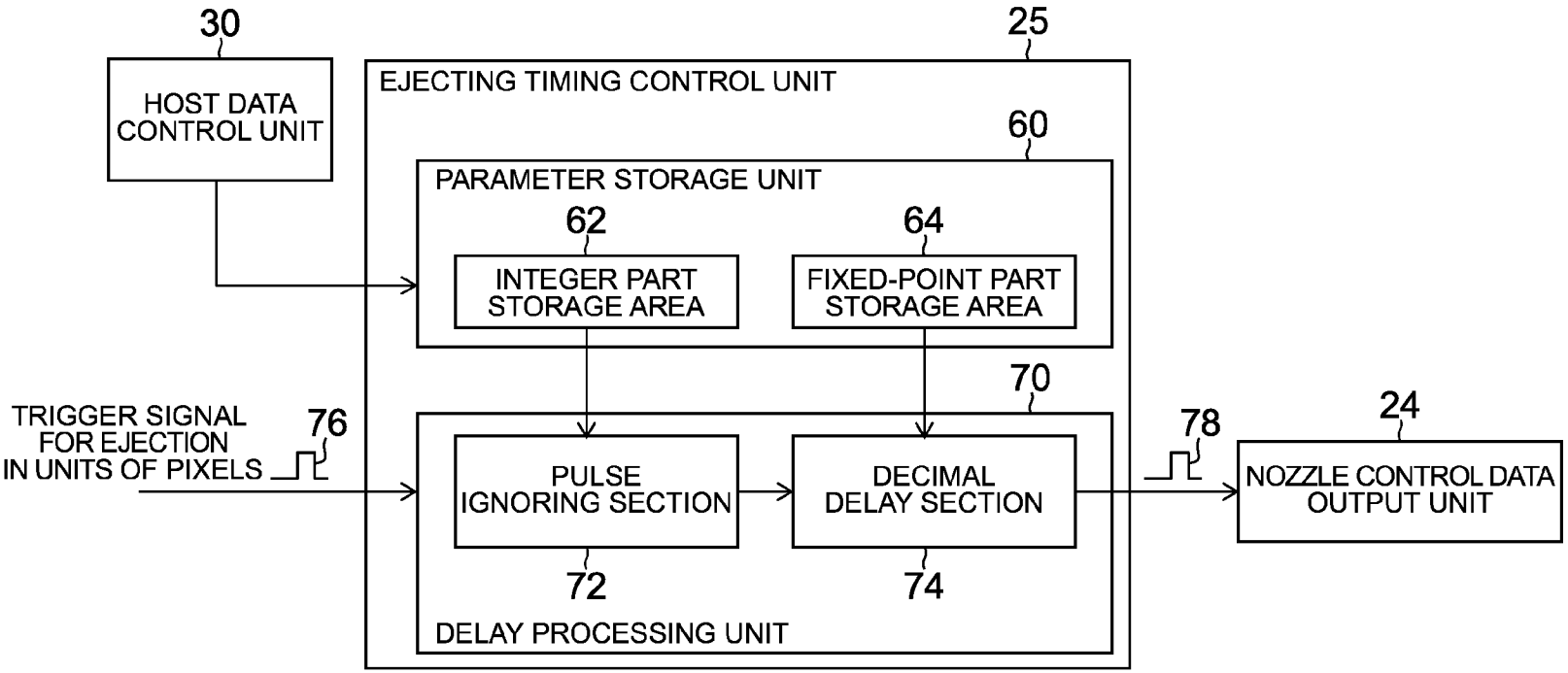
FIG. 8 is a block diagram showing an example of a configuration of an ejecting timing control unit.

FIG. 8 is a block diagram showing an example of an outline of processing of the ejecting timing control unit 25. As shown in FIG. 8, the ejecting timing control unit 25 includes a parameter storage unit 60 that holds data on the amount of correction in the Y-direction (referred to as a "correction parameter in the Y-direction"), and a delay processing unit 70 that performs processing for delaying ejecting timing on the basis of the data on the amount of correction in the Y-direction stored in the parameter storage unit 60.

The parameter storage unit 60 is composed of a register that temporarily stores the data on the amount of correction in the Y-direction provided from the host data control unit 30. The parameter storage unit 60 includes an integer part storage area 62 where an integer part of the amount of correction in the Y-direction in terms of pixels is held, a fixed-point part storage area 64 where a fixed-point part of the amount of correction in the Y-direction is held. For example, in a case where the amount of correction in the Y-direction (in terms of pixels) is indicated as a.b (pix) (a and b are integers that satisfy the following: a>0; and b≥0), the "a" of the integer part is held in the integer part storage area 62, and the "b" of the fixed-point part that is a numeric value after the decimal point is held in the fixed-point part storage area 64.

The delay processing unit 70 provides an ejecting timing signal 78 (trigger for starting ejection) created by applying delay of a pulse corresponding to the amount of correction in the Y-direction to a trigger signal for ejection in units of pixels 76 acquired from the feeding unit 32 (refer to FIG. 7) to the nozzle control data output unit 24.

The delay processing unit 70 includes a pulse ignoring section 72 that ignores input pulses by the number of pulses of the integer held in the integer part storage area 62, and a decimal delay section 74 that applies temporal delay corresponding to position adjustment less than one pixel indicated by a fractional value held in the fixed-point part storage area 64 to a pulse passing through the pulse ignoring section 72.

The pulse ignoring section 72 continuously receives a trigger signal for ejection in units of pixels 76 (pulse signal) from the feeding unit 32. In addition, the pulse ignoring section 72 counts the number of pulses of a received trigger signal for ejection 76, and ignores pulses by an integer value (here, an integer "a") in the integer part storage area 62 to emit a pulse signal at the "a+1"-th timing.

Since the decimal delay section 74 counts clock signals of the FPGA to perform delay in a time resolution smaller than a time interval of the trigger signal for ejection in units of pixels. It is preferable that a clock of the FPGA has a frequency sufficiently higher than a frequency of the trigger signal for ejection, and the frequency is at least more than ten times the frequency of trigger signal for ejection. For example, a clock frequency of the FPGA is 60 MHz, and a frequency of the trigger signal for ejection is 25 kHz.

After time of the fixed-point part ("b") held in the fixed-point part storage area 64 is converted into the number of pulses of a clock of the FPGA and the number of pulses is counted by the decimal delay section 74, the ejecting timing signal 78 is outputted.

In this way, the ejecting timing signal 78 to which time delay corresponding to the amount of correction in the Y-direction is performed is created. Image data for the delay processing is stored in the image data memory 22.

(Example of Configuration of Ink Jet Recorder)

Figure 9:
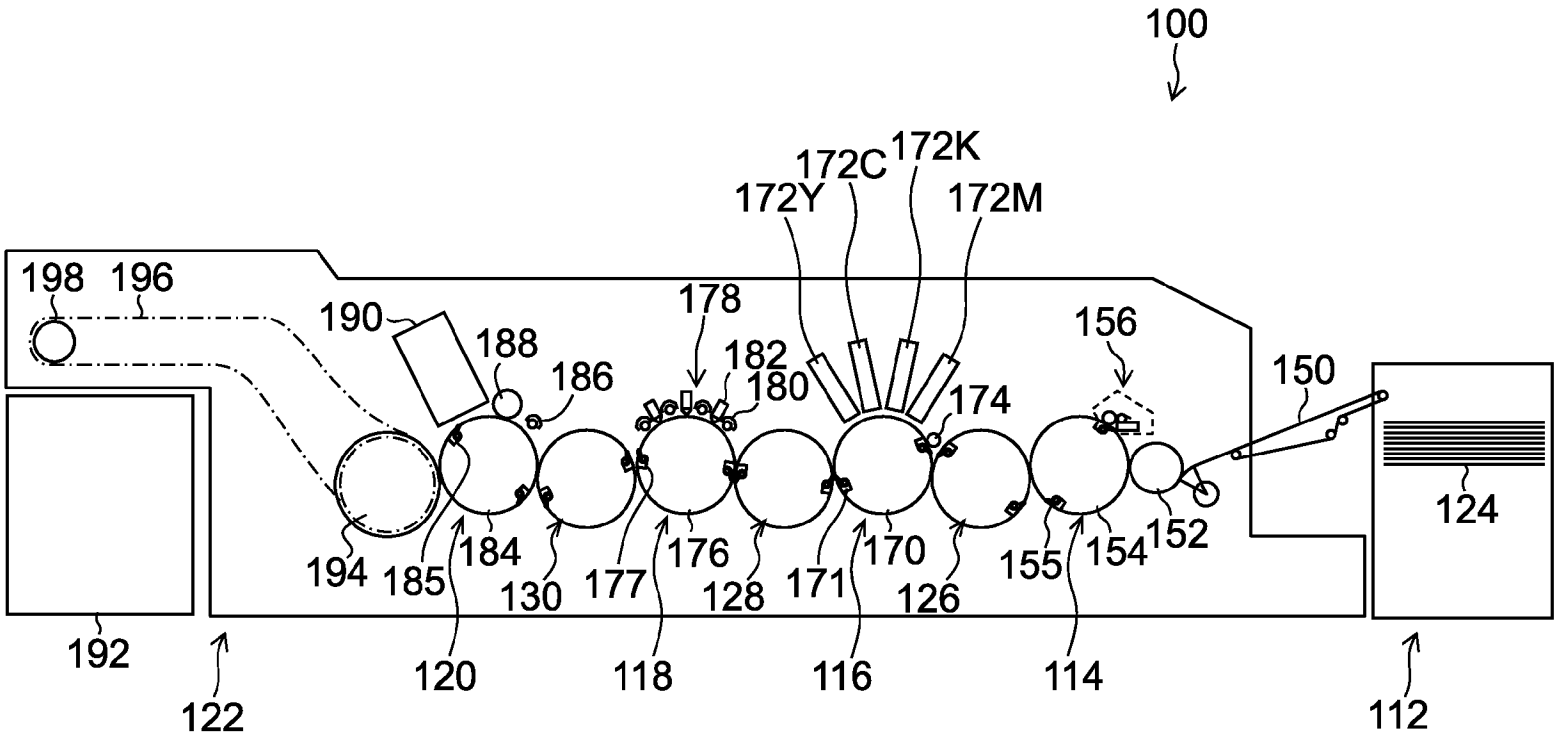
FIG. 9 is a general structural view of an ink jet recorder in accordance with the embodiment of the present invention.

FIG. 9 is a general structural view of an ink jet recorder to which the head-driving device in accordance with the embodiment of the present invention is applied. FIG. 9 shows an ink jet recording device 100 (corresponding to the "image-forming device") that includes a paper feeding unit 112, a treatment liquid applying unit 114, a drawing unit 116, a drying unit 118, a fixing unit 120, and a paper ejection unit 122. An ink jet recorder 100 is an ink jet recorder by a single pass method in which ink jet heads 172M, 172K, 172C, and 172Y eject respective inks of respective multiple colors on a recording medium 124 held around a drawing drum 170 of the drawing unit 116 (hereinafter may be referred to as a "paper sheet" for convenience) to form a desired color image. In addition, the ink jet recorder 100 is an ink jet recorder of an on-demand type to which a two-component reaction (flocculation) method is applied so that a treatment liquid (here, a flocculating treatment liquid) is applied on the recording medium 124 before the inks are ejected to react with ink liquids to form an image on the recording medium 124.

(Feeding Unit)

In the paper feeding unit 112, the recording media 124 that are paper sheets are stacked on each other. The recording medium 124 is fed to the treatment liquid applying unit 114 one by one from a paper feed tray 150 in the paper feeding unit 112. In the present embodiment, although a paper sheet (cut paper) is used as the recording medium 124, a continuous paper sheet (roll paper) may be used so as to be fed after being cut into a sheet of a required size.

(Treatment Liquid Applying Unit)

The treatment liquid applying unit 114 applies a treatment liquid on a recording face of the recording medium 124. The treatment liquid contains a flocculating agent for a color material that flocculates a color material (such as a pigment) in ink applied by the drawing unit 116. The treatment liquid and the ink are brought into contact with each other to promote separation between the color material in the ink and a solvent.

The treatment liquid applying unit 114 includes a paper feed barrel 152, a treatment liquid drum 154, and a treatment liquid coating device 156. The treatment liquid drum 154 holds the recording medium 124 and feeds it by rotating it. In addition, the treatment liquid drum 154 is provided its outer peripheral surface with holding means (gripper) 155 in a claw shape. The recording medium 124 is nipped between a claw of the holding means 155 and the outer peripheral surface of the treatment liquid drum 154 to enable a top end of the recording medium 124 to be held. The treatment liquid drum 154 may be provided in its outer peripheral surface with a suction hole to which suction means is connected to suck through the suction hole. Accordingly, it is possible to bring the recording medium 124 into intimate contact with the outer peripheral surface of the treatment liquid drum 154.

The treatment liquid coating device 156 is provided outside the treatment liquid drum 154 so as to face the outer peripheral surface of the treatment liquid drum 154. The treatment liquid coating device 156 is composed of: a treatment liquid container in which the treatment liquid is contained; an annex roller (metering roller), a part of which is immersed in the treatment liquid in the treatment liquid container; and a rubber roller that is pressed on the annex roller and the recording medium 124 on the treatment liquid drum 154 to transfer the treatment liquid after being metered to the recording medium 124. According to the treatment liquid coating device 156, it is possible to apply the treatment liquid to the recording medium 124 while metering the treatment liquid.

Although the present embodiment shows an example of a configuration in which a coating method by using a roller is applied, the configuration is not limited to the above. For example, various methods, such as a spray method and an ink jet method, are applicable.

The recording medium 124 to which the treatment liquid is applied in the treatment liquid applying unit 114 is delivered from the treatment liquid drum 154 to the drawing drum 170 of the drawing unit 116 through an intermediate feeding unit 126.

(Drawing Unit)

The drawing unit 116 includes the drawing drum 170 (corresponding to the "feeding unit"), a paper sheet pressing roller 174, and the ink jet heads 172M, 172K, 172C, and 172Y. The configuration of the line head 10 shown in FIGS. 1 to 3, and the configuration of the head control unit 20 shown in FIG. 7, are applied to the ink jet heads 172M, 172K, 172C, and 172Y of respective colors, and a control device thereof, respectively.

As with the treatment liquid drum 154, the drawing drum 170 is provided its outer peripheral surface with holding means (gripper) 171 in a claw shape. The recording medium 124 fixed to the drawing drum 170 is fed so that its recording face faces outward, and the ink jet heads 172M, 172K, 172C, and 172Y apply ink to the recording face.

Each of the ink jet heads 172M, 172K, 172C, and 172Y (corresponding to the "line head") is a recording head of a full line type of an ink jet method with a length corresponding to a maximum width of an image formation area on the recording medium 124, and whose ink ejecting face is provided with a nozzle array (two-dimensional arrangement nozzle) in which a plurality of nozzles for ink ejection is arranged across the entire width of the image formation area. Each of the ink jet heads 172M, 172K, 172C, and 172Y is provided so as to extend in a direction orthogonal to a feeding direction (a rotation direction of the drawing drum 170) of the recording medium 124.

In each of the ink jet heads 172M, 172K, 172C, and 172Y, a cassette of a color ink corresponding to each of the ink jet heads is attached. The ink jet heads 172M, 172K, 172C, and 172Y, eject ink droplets toward the recording face of the recording medium 124 held on the outer peripheral surface of the drawing drum 170.

Accordingly, the treatment liquid applied to the recording face in advance is brought into contact with the ink, so that color materials (pigments) dispersed in the ink is flocculated to form a flocculated color material. As an example of reaction between the ink and the treatment liquid, the present embodiment uses a mechanism in which the treatment liquid contains acid to reduce PH so that pigment dispersion is broken to form a flocculated pigment, thereby preventing blurred color material, a mixed color between respective color inks, and deposition interference due to a united liquid when ink droplets are deposited. Accordingly, a flow of color material on the recording medium 124, and the like, are prevented to form an image on the recording face of the recording medium 124.

Ejection timing of each of the ink jet heads 172M, 172K, 172C, and 172Y is synchronized with an encoder (not shown in FIG. 9, and designated by reference numeral 294 in FIG. 14) that is arranged in the drawing drum 170, and that detects a rotary speed of the drawing drum 170. The trigger signal for ejection in units of pixels (designated by reference numeral 76 in FIG. 8) is emitted on the basis of a detection signal from the encoder. The ejecting timing signal (designated by reference numeral 78 in FIG. 8) for each of the head modules is created by delaying the pixel unit trigger signal for ejection in accordance with the amount of correction in the Y-direction. Accordingly, it is possible to determine a deposition position with high accuracy. In addition, it is possible to reduce uneven ejection by learning speed variation due to runout or the like of the drawing drum 170 in advance to correct ejecting timing acquired by the encoder, regardless of runout of the drawing drum 170, accuracy of a rotating shaft, and a speed of the outer peripheral surface of the drawing drum 170.

Further, it is preferable to perform maintenance operation for nozzle faces of each of the ink jet heads 172M, 172K, 172C, and 172Y, such as cleaning, and ejecting thickened ink, after a head unit is retracted from the drawing drum 170.

Although the present embodiment shows an example of a configuration of standard colors of CMYK (four colors), a combination of an ink color and the number of colors is not limited to the above. If necessary, a light-colored ink, a deep color ink, and a specific color ink, may be added. For example, it is also possible to make a configuration in which an ink jet head for ejecting lighted color ink, such as light cyan, and light magenta, is added, and the order of arrangement of each of color heads is not particularly limited.

The recording medium 124 on which an image is formed by the drawing unit 116 is delivered from the drawing drum 170 to a drying drum 176 of the drying unit 118 through an intermediate feeding unit 128.

(Drying Unit)

The drying unit 118 has a mechanism of drying moisture contained in a solvent separated due to action of flocculating color material. The drying unit 118 includes the drying drum 176, and a solvent drying apparatus 178. As with the treatment liquid drum 154, the drying drum 176 is provided its outer peripheral surface with holding means (gripper) 177 in a claw shape. The holding means 177 enables a top end of the recording medium 124 to be held.

The solvent drying apparatus 178 is arranged at a position facing an outer peripheral surface of the drying drum 176, and is composed of a plurality of halogen heaters 180, and warm air ejecting nozzles 182 each of which is arranged between each of the halogen heaters 180. It is possible to achieve various drying conditions by appropriately adjusting a temperature and a flow rate of warm air sprayed from each of the warm air ejecting nozzles 182 toward the recording medium 124, and a temperature of each of the halogen heaters 180.

The recording medium 124 is held on the outer peripheral surface of the drying drum 176 so that the recording face of the recording medium 124 faces outward (that is, in a state where the recording medium 124 is curved so that the recording face thereof projects), and is dried while being rotated and fed. As a result, it is possible of prevent wrinkles and floating of the recording medium 124 from occurring to enable uneven drying caused by the defects above to be reliably prevented.

The recording medium 124 to which drying processing is applied by the drying unit 118 is delivered from the drying drum 176 to a fixing drum 184 of the fixing unit 120 through an intermediate feeding unit 130.

(Fixing Unit)

The fixing unit 120 includes the fixing drum 184, halogen heaters 186, a fixing roller 188, and an in-line sensor 190. As with the treatment liquid drum 154, the fixing drum 184 is provided its outer peripheral surface with holding means (gripper) 185 in a claw shape, and the holding means 185 enables a top end of the recording medium 124 to be held.

As the fixing drum 184 is rotated, the recording medium 124 is fed so that its recording face faces outward. Then, preheating with the halogen heaters 186, fixing processing with the fixing roller 188, and inspection with the in-line sensor 190, are applied to the recording face of the recording medium 124.

The fixing roller 188 is a roller member that heats and presses dried ink to melt and stick self-dispersing polymer fine particles in ink to allow the ink to be coated. The fixing roller 188 heats and presses the recording medium 124.

The in-line sensor 190 is reading means for measuring an image (including a test pattern and the like) recorded on the recording medium 124 for density of a pattern for checking ejection failure and the image, and for failure of the image, and a charge coupled device (CCD) line sensor, or the like, is applied to the in-line sensor 190.

Instead of ink containing a solvent with a high boiling point and fine particles of a polymer (particles of thermoplastic resin), a monomer component capable of being polymerized and cured by exposure to ultraviolet light (UV) may be contained. In this case, the ink jet recorder 100 includes a UV exposure unit that exposes ink on the recording medium 124 to UV light instead of a hot pressing fixing unit (fixing roller 188) by using a heat roller. In this way, in a case where ink containing an active light curable resin such as a UV-curable resin is used, there is provided means for emitting active light, such as a UV lamp and an ultraviolet light laser diode (LD) array, instead of the fixing roller 188 for heating and fixing.

(Paper Ejection Unit)

The paper ejection unit 122 is provided, followed by the fixing unit 120. The paper ejection unit 122 includes an ejection tray 192, and in a space between the ejection tray 192 and the fixing drum 184 of the fixing unit 120, a delivery barrel 194, a feed belt 196, and a stretching roller 198, are provided so as to be brought into contact with the ejection tray 192 and the fixing drum 184. The recording medium 124 is fed to the feed belt 196 by the delivery barrel 194 to be ejected to the ejection tray 192. Although details of a mechanism of feeding a paper sheet by the feed belt 196 is not illustrated, a top end of the recording medium 124 after printing is held by grippers of bars (not shown) provided across the endless feed belt 196, and as the feed belt 196 is rotated, the recording medium 124 is delivered to above the ejection tray 192.

In addition, the ink jet recorder 100 includes means for supplying the treatment liquid to an ink storing and charging unit, or the treatment liquid applying unit 114 that supplies ink to each of the ink jet heads 172M, 172K, 172C, and 172Y. Further, the ink jet recorder 100 includes: a head maintenance unit that performs cleaning (such as wiping a nozzle face, purging, sucking a nozzle) of each of the ink jet heads 172M, 172K, 172C, and 172Y; a position detection sensor that detects a position of the recording medium 124 in a paper sheet feeding path; and a temperature sensor that detects a temperature in every part of the device.

(Example of Configuration of Ink Jet Head)

Next, structures of the ink jet heads will be described. Since the structures of the ink jet heads 172M, 172K, 172C, and 172Y, corresponding to respective colors, are common to each other, hereinafter the head is designated by reference numeral 172 as a representative of the ink jet heads.

Figure 10:
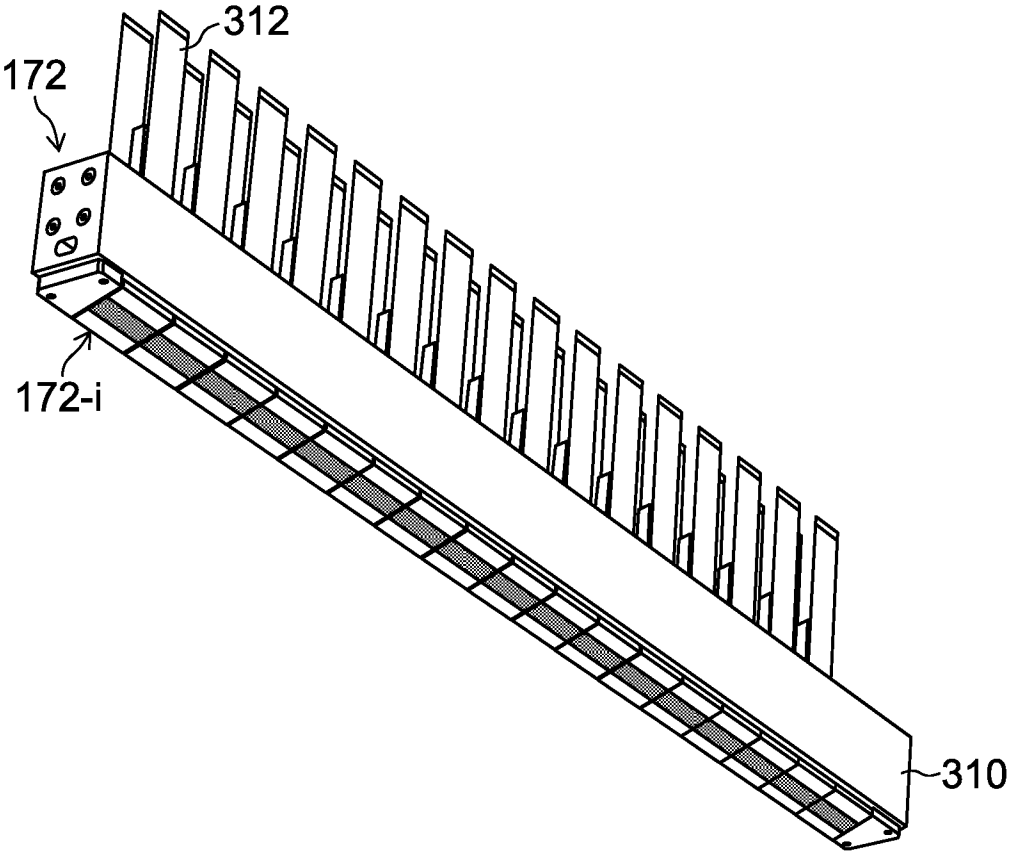
FIG. 10 is a perspective view showing an example of a configuration of an ink jet head.
Figure 11:
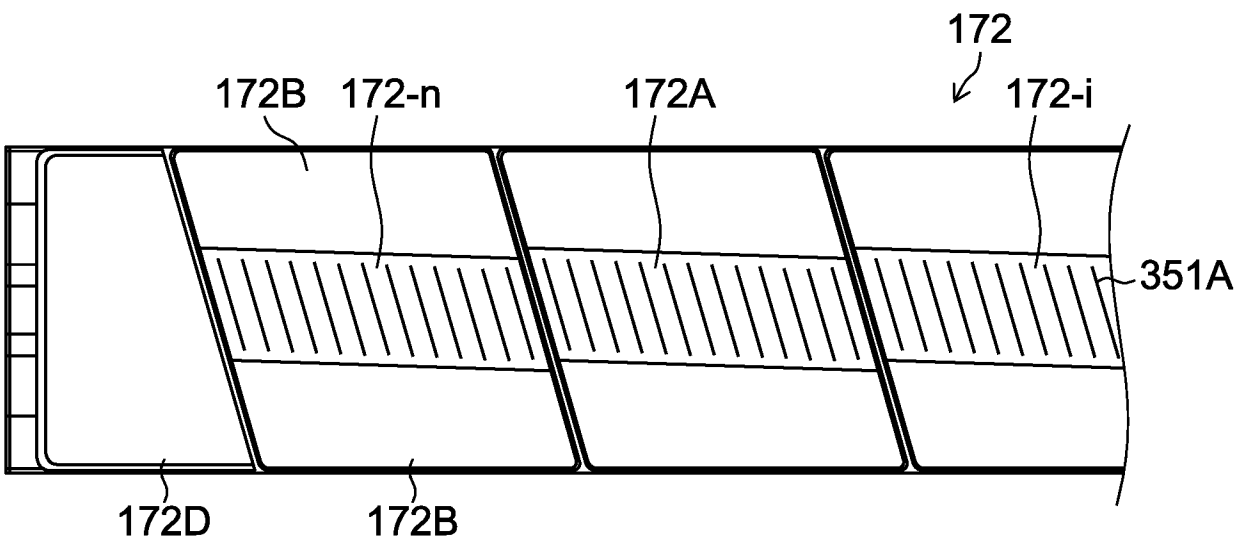
FIG. 11 is an enlarged view of the ink jet head of FIG. 10 as viewed from a nozzle face side.

FIG. 10 is a perspective view of the ink jet head used in the embodiments of the present invention. FIG. 10 shows a state where a nozzle face is viewed from below the head (oblique downward direction). The ink jet head 172 is a line head of a full line type (page-wide head of a single pass print method) that is formed in an elongated strip shape by joining a plurality of numbers (number of n) of head modules 172-*i* (i=1, 2 . . . n) arranged in a width direction of a paper sheet to each other. Here, although there is shown an example in which seventeen head modules 172-*i* are joined to each other, a configuration of modules, the number of the modules, and an arrangement form of thereof, are not limited to the example shown. In FIG. 10, reference numeral 310 designates a housing (a housing for constituting a bar-like line head) that serves as a frame body for fixing the plurality of head modules 172-*i*, and reference numeral 312 designates a flexible substrate connected to each of the head modules 172-*i*. FIG. 11 is an enlarged view of the ink jet head 172 as viewed from a nozzle face 172A side. Each of the head modules 172-*i* is supported by respective head module support members 172B from both sides of the ink jet head 172 in a lateral direction. In addition, both ends of the ink jet head 172 in a longitudinal direction are supported by respective head protective members 172D.

Each of the head modules 172-*i* (n-th head module 172-*n*) has a structure in which a plurality of nozzles is arranged in a matrix shape. In FIG. 11, an inclined solid line designated by reference numeral 351A shows a nozzle array in which a plurality of nozzles is arranged in a line.

The head modules 172-*i* constituting the ink jet head 172 can be replaced in units of a module.

Figure 12:
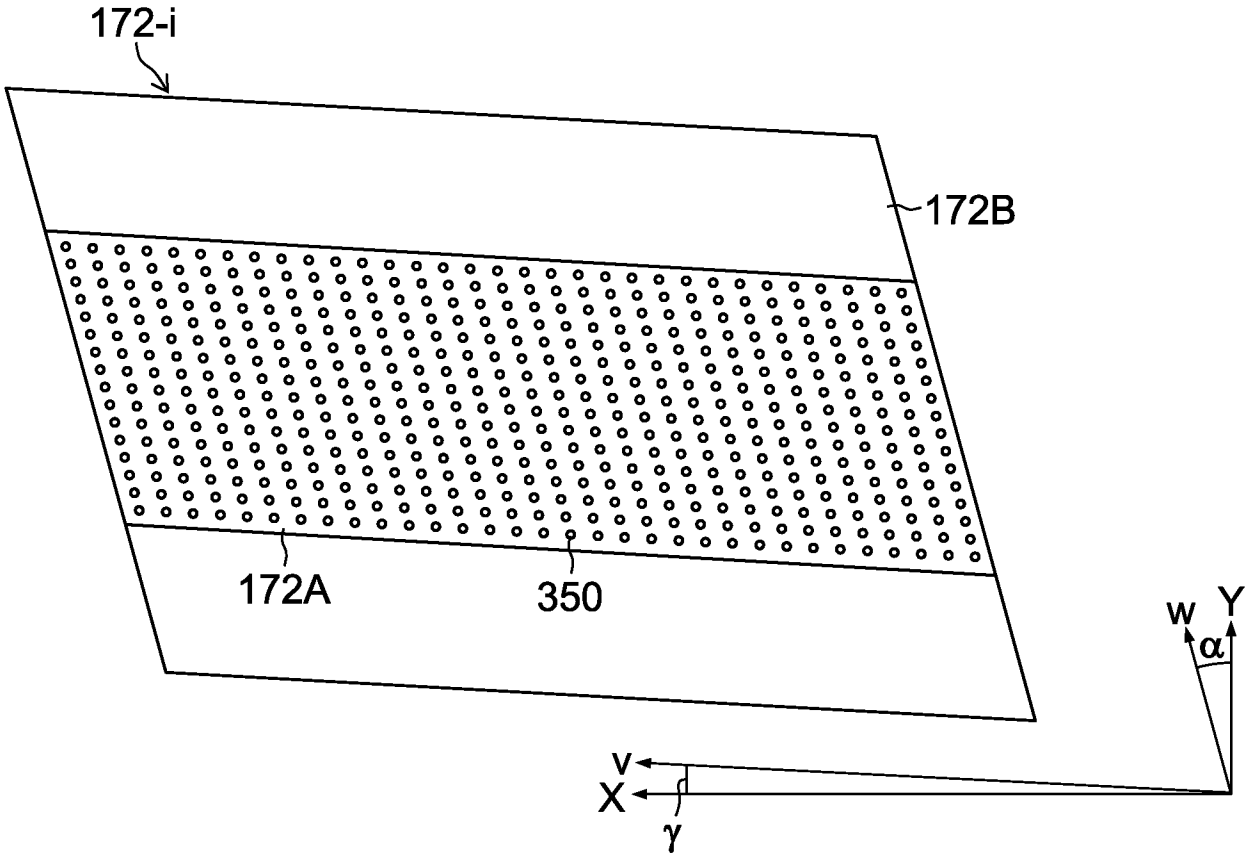
FIG. 12 is a plan view showing an example of nozzle arrangement of the head module.

FIG. 12 is a plan view of the nozzle face 172A in the head modules 172-*i* (as viewed from an ejecting side). Although FIG. 12 shows the nozzle face 172A by omitting the number of nozzles, an ink ejecting face of one head module 172-*i* is provided with a two-dimensional array in which nozzles 350 of the number of 32×64 are arranged, for example. In FIG. 12, the Y-direction is the feeding direction (sub-scanning direction) of the recording medium (paper sheet), and the X-direction is the width direction of the recording medium (main scanning direction). The head module 172-*i* is formed in a plane shape of a parallelogram with edge faces of a long side along a v-direction at an angle $\gamma$ with respect to the X-direction, and edge faces of a short side along a w-direction at an angle $\alpha$ with respect to the Y-direction. A plurality of this kind of the head modules 172-*i* is joined to each other in the X-direction (width direction of the paper sheet) (refer to FIG. 11), so that there is formed a nozzle array with which the entire drawing range in a width of the paper sheet is covered. As a result, there is formed a head of a full line type capable of recording an image at a predetermined recording resolution (such as 1200 dpi) in one scan of a drawing.

The print head of a full line type for single pass print may be provided with a nozzle array required for drawing within a predetermined drawing area in a case where a part of a surface of the recording medium 124 is set as a drawing area (such as a case where a non-drawing area (margin) is set in a periphery of a paper sheet) other than a case where the entire areas of the recording medium 124 are set as a drawing range.

In a case of an ink jet head (matrix head) with a two-dimensional nozzle array, it can be conceived that a projected nozzle array in which each of nozzles in the two-dimensional nozzle array is projected (orthogonal projection) so as to be arranged along a direction orthogonal to a feeding direction of a paper sheet (corresponding to the "main scanning direction") is equivalent to a nozzle array in which the nozzles are arranged in a line at approximately equal intervals at nozzle density for achieving a recording resolution in the main scanning direction (medium width direction). The "approximately equal interval" means that a recordable depositing point in an ink jet printing system is set at a substantially equal interval. For example, a concept of the "equal interval" includes also a case where each of intervals is slightly varied in consideration of displacement of droplets on a medium due to an error in manufacturing and interference of deposition. In consideration of the projected nozzle array (also referred to as "substantial nozzle array"), a nozzle position (nozzle number) can be associated with the order of arrangement of the projected nozzles arranged along the main scanning direction.

When the present invention is practiced, an array form of the nozzles 350 in the head modules 172-*i* is not limited to the example shown in FIG. 12, and various nozzle array structures are applicable. For example, instead of the matrix array described in FIG. 12, there are available a straight line array in a line, a nozzle array in a V-shape, and a nozzle array in a polygonal shape such as a zigzag-shape (such as a W-shape) in repeating units of a V-shape array.

(Inner Structure of Head)

Figure 13:
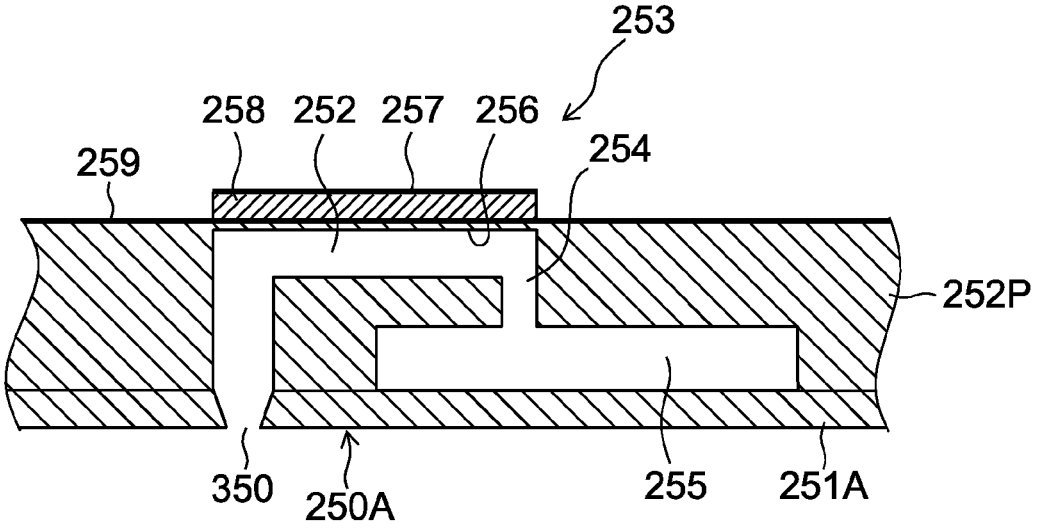
FIG. 13 is a sectional view showing an example of a structure for one nozzle of the ink jet head.

FIG. 13 is a sectional view showing an example of a structure of a droplet ejecting element for one channel to be in units of a recording element (in units of an ejecting element) in the ink jet head. As shown in FIG. 13, in the ink jet head 172, nozzles 350 serving as ink ejecting ports, and a plurality of ink chamber units (droplet ejecting elements) 253 each of which includes a pressure chamber 252 corresponding to each of the nozzles 350, are provided to form a two-dimensional array.

The ink jet head 172 includes a nozzle plate 251A in which the nozzles 350 are formed, and a flow channel plate 252P in which the pressure chamber 252 and flow channels such as a common flow channel 255 are formed. The nozzle plate 251A and the flow channel plate 252P are laminated and bonded. The nozzle plate 251A constitutes a nozzle face (ink ejecting face) 250A of a head 250, and is provided with a plurality of nozzles 350 that communicate with the respective pressure chambers 252.

The flow channel plate 252P is a flow channel forming member that constitutes a sidewall portion of the pressure chamber 252, as well as that forms a supply port 254 serving as a throttle (most narrowed portion) of an individual supply channel through which ink is guided from the common flow channel 255 to the pressure chamber 252. In FIG. 13, although the structure is simply shown for convenience of explanation, the flow channel plate 252P has a structure in which one or more substrates are laminated. It is possible to form each of the nozzle plate 251A and the flow channel plate 252P into a required shape by using silicon as a material in a semiconductor manufacturing process.

The common flow channel 255 communicates with an ink tank (not shown) serving as an ink supply source, and ink supplied from the ink tank is supplied to each of the pressure chambers 252 through the common flow channel 255.

The pressure chamber 252 includes a part of faces (a top face in FIG. 13) composed of a vibrating plate 256 on which there is bonded a piezo actuator (piezoelectric element) 258 including an individual electrode 257. The vibrating plate 256 of the present example is composed of silicon (Si) with a nickel (Ni) conductive layer serving as a common electrode 259 corresponding to a bottom electrode of the piezo actuator 258, and also serves as a common electrode of the piezo actuator 258 arranged corresponding to each of the pressure chambers 252. In addition, there is possible an aspect in which a vibrating plate is formed of non-conductive material such as resin, and in this case, a common electrode layer formed of conductive material such as metal is formed on a surface of a member of the vibrating plate. The vibrating plate serving as a common electrode may be composed of metal (conductive material) such as stainless steel (SUS).

When drive voltage is applied to the individual electrode 257, the piezo actuator 258 is deformed to change volume of pressure chamber 252. Accordingly, pressure in the pressure chamber 316 is changed to eject ink from the nozzle 350. When the piezo actuator 258 returns to an original state after the ink is ejected, new ink is supplied from the common flow channel 255 through the supply port 254 so that the pressure chamber 252 is refilled with the new ink.

(Ejecting Method)

In the ink jet head, means for generating pressure (ejecting energy) for ejecting droplets from each of the nozzles is not limited to the piezo actuator (piezoelectric element), and there are available various pressure generation elements (ejecting energy generation elements), such as a heater (heating element) in a thermal method (a method of ejecting ink by using pressure of film boiling caused by heating of a heater), and various actuators in other methods. Depending on an ejecting method of the head, a corresponding energy generation element is provided in a flow channel structure.

(Control System of Ink Jet Recorder 100)

Figure 14:
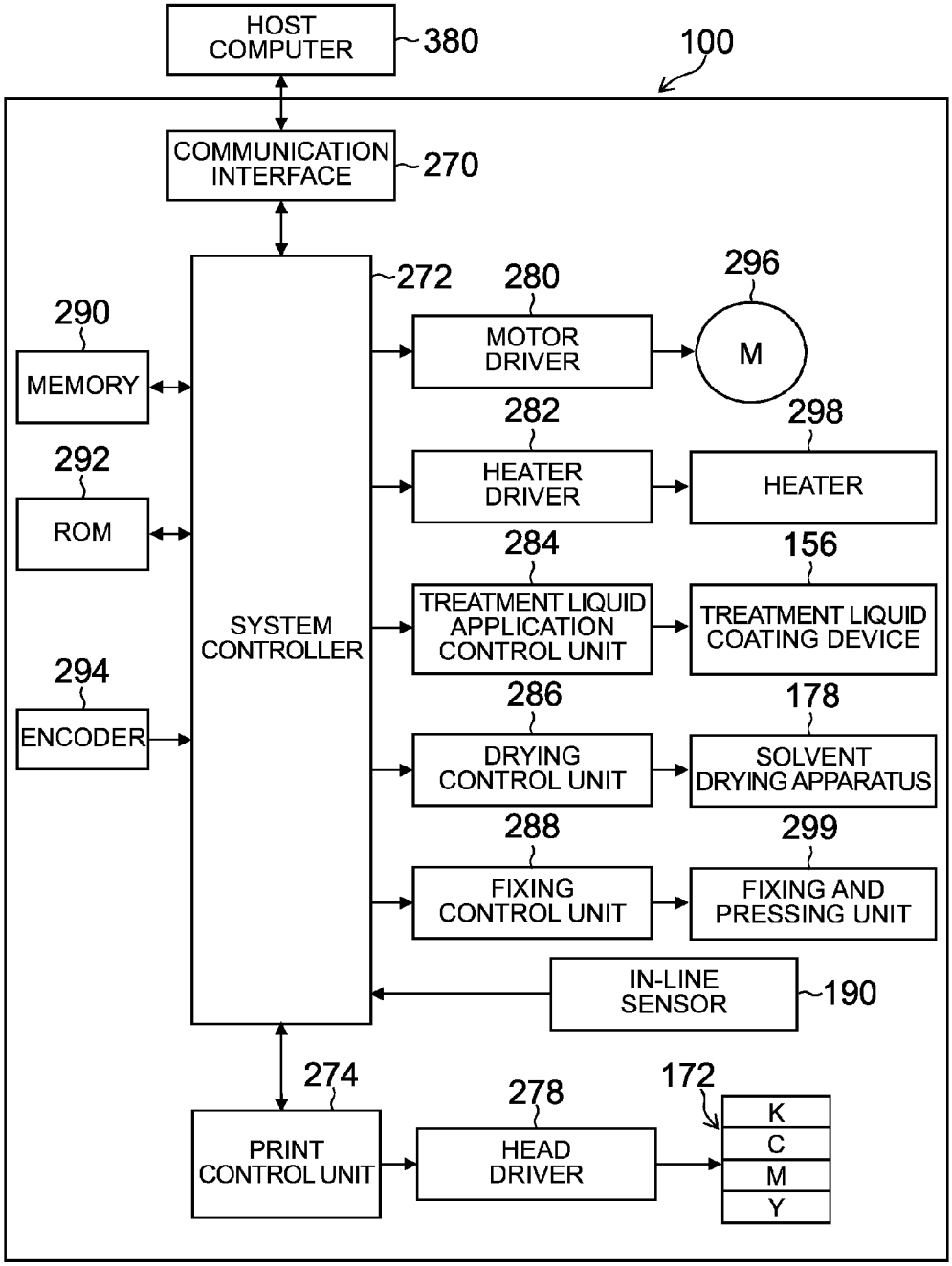
FIG. 14 is a block diagram showing a system configuration of the ink jet recorder.

FIG. 14 is a block diagram of a main section, showing a system configuration of the ink jet recorder 100.

The ink jet recorder 100 includes a communication interface 270, a system controller 272, a print control unit 274, an image buffer memory (not shown), a head driver 278, a motor driver 280, a heater driver 282, a treatment liquid application control unit 284, a drying control unit 286, a fixing control unit 288, a memory 290, a read only memory (ROM) 292, and an encoder 294.

The communication interface 270 serves as an interface section that receives image data transmitted from a host computer 380. For the communication interface 270, there are available a serial interface such as a universal serial bus (USB), IEEE1394, an Ethernet (registered trademark), and a wireless network, as well as a parallel interface such as a Centronics. In this part, a buffer memory (not shown) may be mounted to increase a communication speed. Image data transmitted from the host computer 380 is taken in the ink jet recorder 100 through the communication interface 270, and then is temporarily stored in the memory 290.

The memory 290 is storage means for temporarily storing an image received through the communication interface 270, and in the memory 290, reading and writing of data is performed through the system controller 272. For the memory 290, there may be used not only a memory composed of semiconductor elements but also a magnetism medium such as a hard disk.

The system controller 272 is composed of a central processing unit (CPU), a periphery circuit of the CPU, and the like, and serves as a control device for controlling the entire ink jet recorder 100 in accordance with a predetermined program, as well as serves as an arithmetic unit for performing various calculations. That is, the system controller 272 controls each of the units such as the communication interface 270, the print control unit 274, the motor driver 280, the heater driver 282, and the treatment liquid application control unit 284 and controls communication with the host computer 380 and reading and writing of the memory 290, as well as creates a control signal for controlling a motor 296 and a heater 298 in a feeding system.

The ROM 292 stores various data and the like required for executing a program and control by using the CPU of the system controller 272. The ROM 292 may be not only non-rewritable storage means, but also rewritable storage means. The memory 290 is used as a temporary storage area of image data, as well as is used as an expansion area of a program and a calculation operation area of the CPU.

The motor driver 280 drives the motor 296 in response to a command from the system controller 272. In FIG. 14, the motor is designated by reference numeral 296 as a representative of various motors arranged in respective units in the device. For example, the motor 296 shown in FIG. 14 includes: motors each of which drives the rotation of the paper feed barrel 152, the treatment liquid drum 154, the drawing drum 170, the drying drum 176, the fixing drum 184, the delivery barrel 194, or the like, of FIG. 9; a motor that drives a pump for vacuum suction from a hole of the drawing drum 170; and a motor of a retracting mechanism that moves a head unit of each of the ink jet heads 172M, 172K, 172C, and 172Y to a maintenance area outside the drawing drum 170.

The heater driver 282 drives the heater 298 in response to a command from the system controller 272. In FIG. 14, the heater is designated by reference numeral 298 as a representative of various heaters arranged in respective units in the device. For example, the heater 298 shown in FIG. 14 includes a pre-heater (not shown) for heating the recording medium 124 at a suitable temperature in advance in the paper feeding unit 112.

The print control unit 274 has a signal processing function of performing various types of processing, and correction, for creating a signal for print control from image data in the memory 290 in accordance with control of the system controller 272, and supplies print data (dot data) created to the head driver 278.

The dot data is generally created by applying color conversion processing and halftone processing to multi-gradation image data. The color conversion processing is for converting image data expressed by sRGB (such as 8 bit image data for each of RGB colors) into color data on each of colors of ink to be used in the ink jet recorder 100 (such as color data on KCMY).

The halftone processing is for applying processing of an error diffusion method, a threshold value matrix, and the like, to the color data on each of colors created by the color conversion processing to convert the color data into dot data on each of colors (such as dot data on KCMY).

On the basis of dot data acquired by applying required signal processing to the image data in the print control unit 274, the amount of ejection of ink droplets and ejecting timing of the head 250 is controlled through the head driver 278. Accordingly, a desired dot size and arrangement of dots are achieved. The dot data called here corresponds to the "nozzle control data".

The print control unit 274 includes an image buffer memory (not shown), and at the time of processing of image data in the print control unit 274, the image data, data on parameters, and the lie, are temporarily stored in the image buffer memory. In addition, there is also possible an aspect in which the print control unit 274 and the system controller 272 are integrated to form one processor.

A flow of processing from image input to print output will be summarized below. First, data on an image to be printed is inputted from the outside through the communication interface 270, and is stored in the memory 290. In this stage, for example, image data on RGB is stored in the memory 290. In the ink jet recorder 100, conversion of a dot pattern is required to faithfully reproduce gradation (light and shade of an image) of a digital image inputted to form an image of pseudo continuous gradation for human eyes by changing deposition density and a dot size of a fine dot with ink (color material). Thus, data on an original image (RGB) stored in the memory 290 is transmitted to the print control unit 274 through the system controller 272, and the print control unit 274 applies the half-toning processing using the threshold value matrix, the error diffusion method, and the like, to the data so that the data is converted into dot data for each of ink colors. That is, the print control unit 274 performs processing of converting received RGB image data into dot data on four colors of K, C, M, and Y. As a result, the dot data created by the print control unit 274 is stored in the image buffer memory (not shown).

The head driver 278 outputs a driving signal for diving a actuator corresponding to each of the nozzles of the ink jet head 172 on the basis of print data (or the dot data stored in the image buffer memory (not shown)) supplied from the print control unit 274. The head driver 278 may include a feedback control system for maintaining a drive condition of the head constant.

A driving signal outputted from the head driver 278 is supplied to the head 250 so that ink is ejected form corresponding nozzles. Ink ejection from the head 250 is controlled while the recording medium 124 is fed at a predetermined speed so that an image is formed on the recording medium 124. The ink jet recorder 100 shown in the present example uses a drive method in which a common signal of drive electric power waveforms is applied, in units of a module, to the piezo actuator 258 corresponding to the nozzles 350 of each of the head modules 172-*i* (i=1, 2 . . . n) constituting the ink jet head 172, and ink is ejected from the nozzles 350 corresponding to each of the piezo actuator 258 in accordance with ejecting timing of each of the piezo actuators 258 by switching on/off a switch element (not shown) connected to an individual electrode of each of the piezo actuators 258.

A section of the head driver 278 and the print control unit 274 (including the image buffer memory) corresponds to the head control unit 20 described in FIG. 7. In addition, the system controller 272 of FIG. 14 corresponds to the host data control unit 30 described in FIG. 7.

The treatment liquid application control unit 284 controls operation of the treatment liquid coating device 156 (refer to FIG. 9) in response to a command from the system controller 272. The drying control unit 286 controls operation of the solvent drying apparatus 178 (refer to FIG. 9) in response to a command from the system controller 272.

The fixing control unit 288 controls operation of a fixing and pressing unit 299 including the halogen heater 186 of the fixing unit 120, and the fixing roller 188 (refer to FIG. 9), in response to a command from the system controller 272.

As described in FIG. 9, the in-line sensor 190 is a block including an image sensor. The in-line sensor 190 reads an image printed on the recording medium 124, and performs required signal processing, and the like, to detect a print state (such as ejecting ink or not, a variation of deposits, and optical density), and then provides a result of the detection to the system controller 272 and the print control unit 274.

The print control unit 274 applies various types of correction (non-ejection correction, density correction, and the like) to the head 250 on the basis of information acquired from the in-line sensor 190, as well as controls pre-ejection, suction, and cleaning operation such as wiping (nozzle recovery operation), so as to be performed, if necessary.

(Variation 1)

Figure 15:
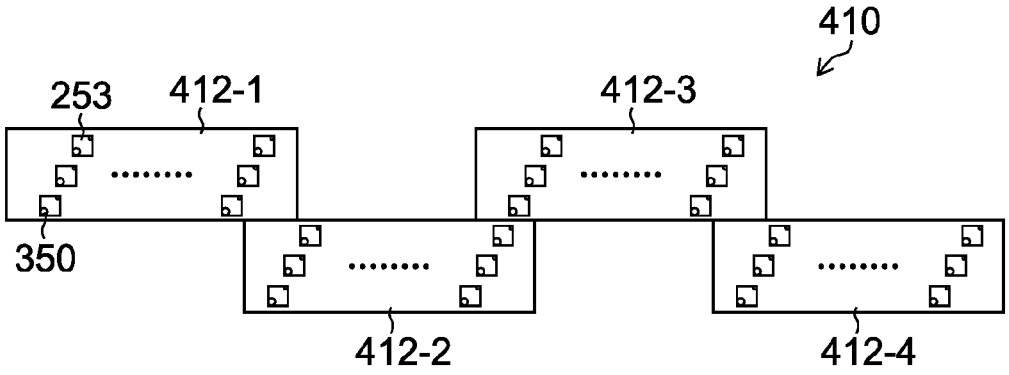
FIG. 15 is a schematic plan view showing an example of another configuration of the line head.

A configuration of a line head composed of a plurality of head modules is not limited to the examples shown in FIGS. 1 to 3, 10, and 11. For example, as shown in FIG. 15, the present invention is applicable to a line head 410 that has a structure in which a plurality of head modules 412-*i* is arranged in a zigzag shape.

(Variation 2)

In the embodiments described above, although an ink jet recorder using a method of forming an image by directly ejecting ink droplets on the recording medium 124 (direct recording method) has been described, scope of application of the present invention is not limited to the above, and the present invention is also applicable to an ink jet recorder of an intermediate transfer type in which an image (primary image) is temporarily formed on an intermediate transfer material, and then the image is transferred to a recording paper by a transfer unit so that a final image is formed.

Other Examples of Application

In the embodiments described above, although an example of application to an ink jet recorder for graphic printing has been described, scope of application of the present invention is not limited to the example. The present invention is widely applicable to an image-forming device using an ink jet method that draws various shapes and patterns, such as a wiring drawing device for drawing a wiring pattern of an electronic circuit, a manufacturing apparatus for various devices, a resist printer that uses resin liquid as a functional liquid for ejection, a color filter manufacturing apparatus, and a fine structure forming apparatus that forms a fine structure by using a material for material deposition.

In the embodiments of the present invention described above, constituent features can be appropriately modified, added, and eliminated within a range without departing from the spirit of the present invention. The present invention is not limited to the embodiments described above, and a person with ordinary skill in the field can make many modifications within a technical idea of the present invention.

What is claimed is:

1. A head adjustment method for adjusting a recording position of each of a plurality of head modules of a line head formed by a combination of the plurality of head modules, the head adjustment method comprising the steps of:

measuring an amount of misregistration for each of the head modules, corresponding to an amount of relative misregistration of each of the head modules in a direction parallel to a feeding direction of a recording medium, with reference to a position of a slowest module among the plurality of head modules, the slowest module being arranged on a most downstream side in the feeding direction of the recording medium with respect to a line head;

determining an amount of correction of each of the head modules by determining a value corresponding to an amount in which an amount of an offset more than a mounting tolerance of the head modules in the direction parallel to the feeding direction is added to the amount of misregistration measured for each of the head modules;

storing the amount of correction in a storage unit; and controlling recording timing of each of the head modules on a basis of the amount of correction stored in the storage unit.

2. The head adjustment method according to claim 1, further comprising, in a case where a part of the plurality of head modules is replaced, the steps of:

acquiring the amount of relative misregistration of the replaced head module in the direction parallel to the feeding direction in a mounting state after replacement; and determining an amount of correction for the replaced head module on a basis of the acquired amount instead of an amount of correction set to the head module before the replacement; and storing the amount of correction after the replacement in the storage unit, wherein recording timing of the replaced head module is controlled on a basis of the amount of correction after the replacement, and recording timing of a non-replaced head module is controlled on a basis of the amount of correction before the replacement.

3. The head adjustment method according to claim 2, further comprising the steps of:

holding image data for at least a pixel row corresponding to the amount of the offset in an image data memory unit;

outputting nozzle control data for controlling an ejecting operation of each of nozzles in each of the head modules in response to a timing signal generated in accordance with the amount of correction; and driving an ejecting energy generation element corresponding to each of the nozzles in the respective head modules by outputting a driving voltage signal to the ejecting energy generation element.

4. The head adjustment method according to claim 3, wherein the amount of correction is indicated by a numeric value in terms of pixels defined by a recording resolution realized by relative movement between the line head and the recording medium.

5. The head adjustment method according to claim 2, wherein the amount of correction is indicated by a numeric value in terms of pixels defined by a recording resolution realized by relative movement between the line head and the recording medium.

6. The head adjustment method according to claim 1, wherein the step of controlling timing includes delay processing of delaying recording timing in accordance with the amount of correction.

7. The head adjustment method according to claim 6, further comprising the steps of:

holding image data for at least a pixel row corresponding to the amount of the offset in an image data memory unit;

outputting nozzle control data for controlling an ejecting operation of each of nozzles in each of the head modules in response to a timing signal generated in accordance with the amount of correction; and driving an ejecting energy generation element corresponding to each of the nozzles in the respective head modules by outputting a driving voltage signal to the ejecting energy generation element.

8. The head adjustment method according to claim 7, wherein the amount of correction is indicated by a numeric value in terms of pixels defined by a recording resolution realized by relative movement between the line head and the recording medium.

9. The head adjustment method according to claim 6, wherein the amount of correction is indicated by a numeric value in terms of pixels defined by a recording resolution realized by relative movement between the line head and the recording medium.

10. The head adjustment method according to claim 1, further comprising the steps of:

holding image data for at least a pixel row corresponding to the amount of the offset in an image data memory unit;

outputting nozzle control data for controlling an ejecting operation of each of nozzles in each of the head modules in response to a timing signal generated in accordance with the amount of correction; and driving an ejecting energy generation element corresponding to each of the nozzles in the respective head modules by outputting a driving voltage signal to the ejecting energy generation element.

11. The head adjustment method according to claim 10, wherein the amount of correction is indicated by a numeric value in terms of pixels defined by a recording resolution realized by relative movement between the line head and the recording medium.

12. The head adjustment method according to claim 1, wherein the amount of correction is indicated by a numeric value in terms of pixels defined by a recording resolution realized by relative movement between the line head and the recording medium.

13. A head-driving device that controls a recording operation of each of a plurality of head modules of a line head formed by a combination of the plurality of head modules, the head-driving device comprising:

a storage unit that stores an amount of correction of each of the head modules that is a value corresponding to an amount acquired by adding an amount of an offset more than a mounting tolerance of the head modules in a direction parallel to the feeding direction to an amount of misregistration for each of the head modules corresponding to an amount of relative misregistration for each of the head modules in the direction parallel to the feeding direction that is acquired with reference to a position of a slowest module among the plurality of head modules, the slowest module being arranged on a most downstream side in the feeding direction of the recording medium with respect to the line head; and a timing control unit that controls recording timing of the head modules on a basis of the amount of correction stored in the storage unit.

14. The head-driving device according to claim 13, wherein in a case where a part of the plurality of head modules is replaced, an amount of correction after replacement is set for the replaced head module instead of the amount of correction set to the head module before replacement, the amount of correction after the replacement is stored in the storage unit, and recording timing of the replaced head module is controlled on a basis of the amount of correction after the replacement, and recording timing of a non-replaced head module is controlled on a basis of an amount of correction same as the amount of correction before the replacement.

15. The head-driving device according to claims 13, wherein the timing control unit includes a delay processing section that delays a trigger signal for ejection in units of pixels to be inputted to the timing control unit in accordance with the amount of correction.

16. The head-driving device according to claim 15, further comprising:

an image data memory unit that is capable of holding image data for a pixel row corresponding to at least the amount of offset;

a nozzle control data output unit that outputs nozzle control data for controlling an ejecting operation of each of nozzles in the respective head modules in response to the timing signal from the timing control unit; and a driving unit that outputs a driving voltage signal to an ejecting energy generation element corresponding to each of the nozzles in the respective head modules to drive the ejecting energy generation element.

17. The head-driving device according to claim 13, further comprising:

an image data memory unit that is capable of holding image data for a pixel row corresponding to at least the amount of offset;

a nozzle control data output unit that outputs nozzle control data for controlling an ejecting operation of each of nozzles in the respective head modules in response to the timing signal from the timing control unit; and a driving unit that outputs a driving voltage signal to an ejecting energy generation element corresponding to each of the nozzles in the respective head modules to drive the ejecting energy generation element.

18. An image-forming device comprising:

a line head that is formed in combination with a plurality of head modules;

a feeding unit that feeds the recording medium with respect to the line head; and the head-driving device according to claim 13.

* * * * *